US006647836B1

(12) United States Patent
Habermehl

(10) Patent No.: US 6,647,836 B1
(45) Date of Patent: Nov. 18, 2003

(54) LOCKABLE TELESCOPING SCREWDRIVER

(76) Inventor: G. Lyle Habermehl, 436 Calvert Dr., Gallatin, TN (US) 37066

( * ) Notice: Subject to any disclaimer, the term of this patent is extended or adjusted under 35 U.S.C. 154(b) by 0 days.

(21) Appl. No.: 09/673,917

(22) PCT Filed: Apr. 24, 1998

(86) PCT No.: PCT/CA98/00432

§ 371 (c)(1),
(2), (4) Date: Oct. 23, 2000

(87) PCT Pub. No.: WO99/55494

PCT Pub. Date: Nov. 4, 1999

Related U.S. Application Data

(63) Continuation-in-part of application No. 08/741,278, filed on Oct. 30, 1996, now Pat. No. 5,855,151.

(51) Int. Cl.[7] ..... B25B 23/04

(52) U.S. Cl. ..... 81/434; 81/57.37; 227/125; 173/107

(58) Field of Search ..... 81/434, 57.37, 81/57.23, 433, 435; 227/125, 126, 135, 120, 136; 144/32; 173/107; 226/77, 157

(56) References Cited

U.S. PATENT DOCUMENTS

| | | | | | |
|---|---|---|---|---|---|
| 1,815,594 | A | * | 7/1931 | Shaw et al. | 81/57.37 |
| 3,601,168 | A | * | 8/1971 | Fernstrom | 81/435 |
| 3,623,646 | A | * | 11/1971 | Cast et al. | 227/136 |
| 3,826,419 | A | * | 7/1974 | Maestri | 227/136 |
| 3,891,014 | A | | 6/1975 | Gunn | |
| 3,910,324 | A | | 10/1975 | Nasiatka | |
| 3,920,324 | A | * | 11/1975 | Otto | 353/117 |
| 3,930,297 | A | * | 1/1976 | Potucek et al. | 29/431 |
| 4,018,254 | A | * | 4/1977 | DeCaro | 81/57.37 |
| 4,019,631 | A | | 4/1977 | Lejdegard et al. | |
| 4,146,071 | A | * | 3/1979 | Mueller et al. | 81/434 |
| 4,167,229 | A | * | 9/1979 | Keusch et al. | 206/343 |
| 4,302,991 | A | | 12/1981 | Brouse et al. | |
| 4,404,877 | A | * | 9/1983 | Mizuno et al. | 81/57.37 |
| 4,428,261 | A | * | 1/1984 | Takatsu et al. | 81/434 |
| 4,625,597 | A | * | 12/1986 | Cast | 81/57.37 |
| 4,930,630 | A | * | 6/1990 | Habermehl | 206/347 |
| 4,998,452 | A | * | 3/1991 | Blum | 81/57.37 |
| 5,027,679 | A | * | 7/1991 | Kawashima et al. | 81/434 |
| 5,083,483 | A | * | 1/1992 | Takagi | 81/434 |
| 5,186,085 | A | * | 2/1993 | Monacelli | 81/434 |
| 5,231,900 | A | * | 8/1993 | Deri | 81/57.37 |
| 5,284,074 | A | * | 2/1994 | Chen | 81/434 |
| 5,303,620 | A | * | 4/1994 | Payne et al. | 81/434 |
| 5,473,965 | A | * | 12/1995 | Chen | 81/434 |
| 5,531,143 | A | | 7/1996 | Habermehl et al. | |
| 5,568,753 | A | | 10/1996 | Habermehl et al. | |

* cited by examiner

*Primary Examiner*—Joseph J. Hail, III
*Assistant Examiner*—Anthony Ojini
(74) *Attorney, Agent, or Firm*—Dorsey & Whitney LLP

(57) ABSTRACT

A driver attachment (12) for a collated screwstrip (13) carrying screws (16) in which a slide body (20) is slidable in a housing (18) parallel a longitudinal axis (52) about which a drive shaft (34) is rotatable. The slide body (20) receives a screwstrip (13) such that a screw feed activation mechanism coupled between the housing (18) and the slide body (20) advances successive screws (16) into a position to be driven by the drive shaft (34) with relative sliding of the slide body (20) relative the housing (18) between an extended and a retracted position. A latch system is provided to latch the slide body (20) to the housing (18) against extension towards the extended position beyond an extension limit position. With the slide body (20) and housing (18) latched together, the drive attachment (12) may be used to drive or withdraw separate screw (16) independently of the screwstrip, with or without the screwstrip (13) engaged in the slide body (20).

22 Claims, 13 Drawing Sheets

11
10
402
12
406
408
40
25
410
16
13
14

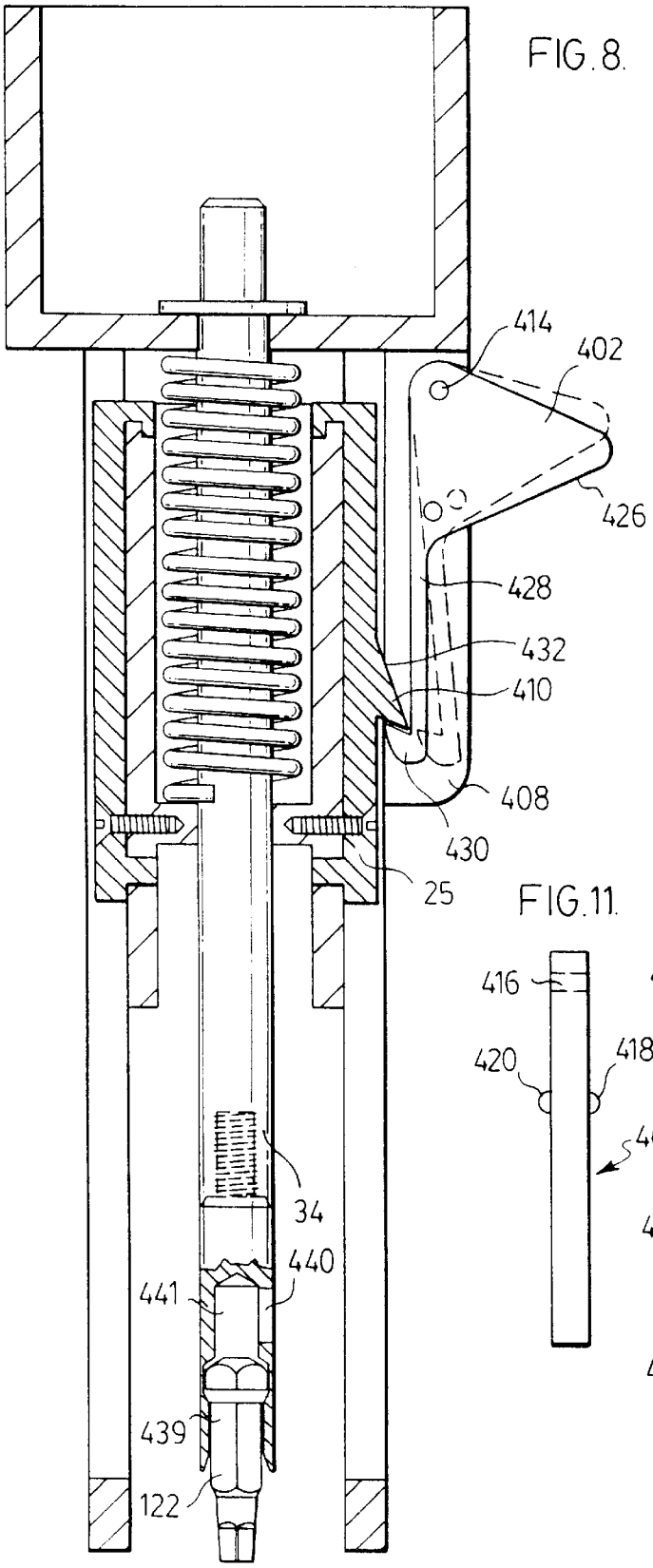
FIG. 8.
FIG. 10.
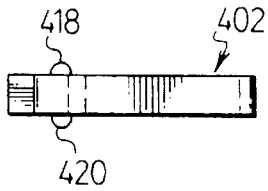
FIG. 11.
FIG. 9.
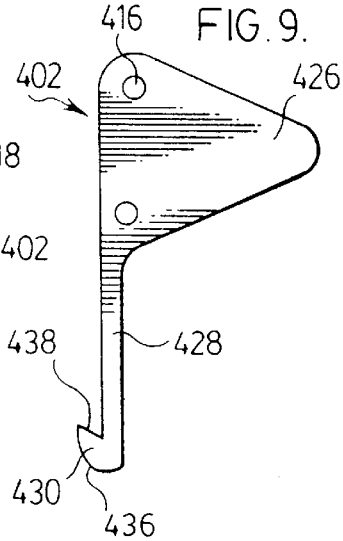

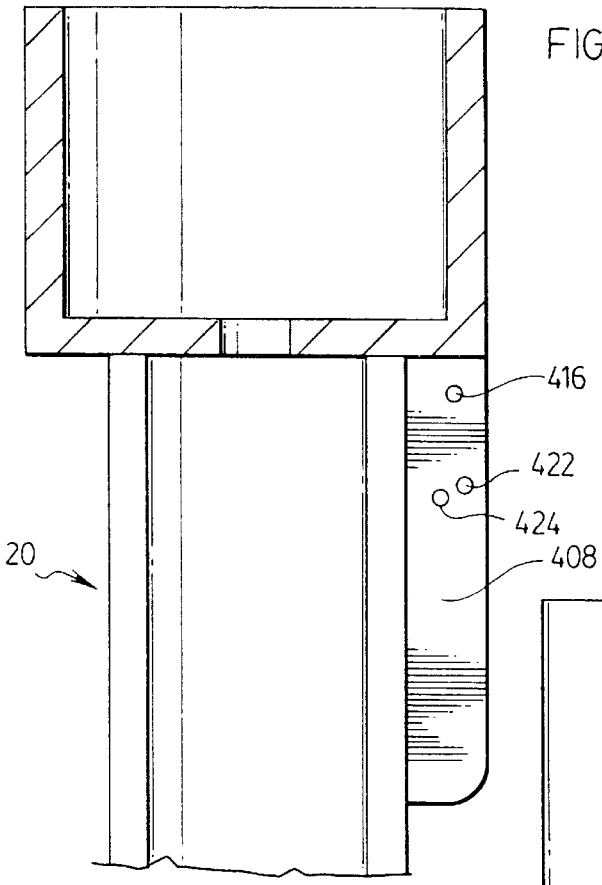
FIG.12.
FIG.13
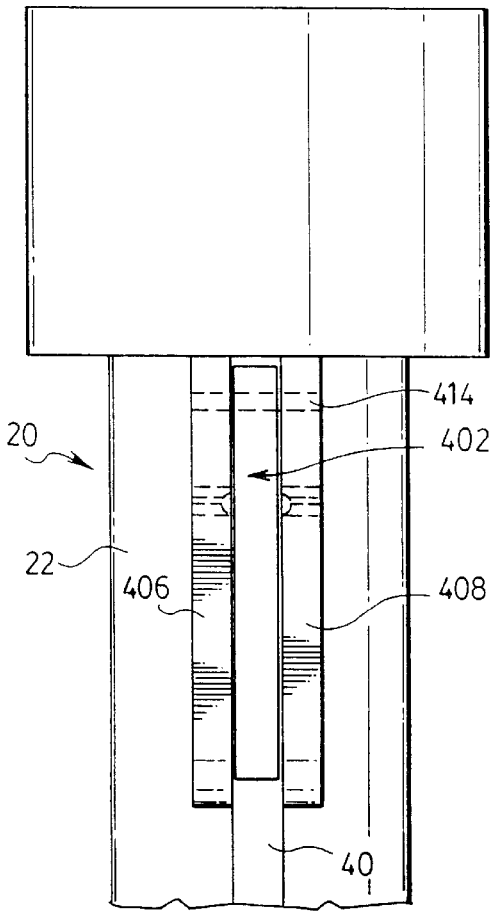

73
70
626
18'
71
72
26
27
546
46
25
28
504
502
18
111
25
22
58
50
114
112
51
18
54
42
56
90
506
82
83
302
85
93
508
80
77
92
510
75
76
40
24
40
87
86
125
83
301
84
118
119
23

622
626

26
27
28
70
624
72
34
46
628
114
630
110
58
38
18
76
88
22
24
13'
82
13
34
118
119
122
96

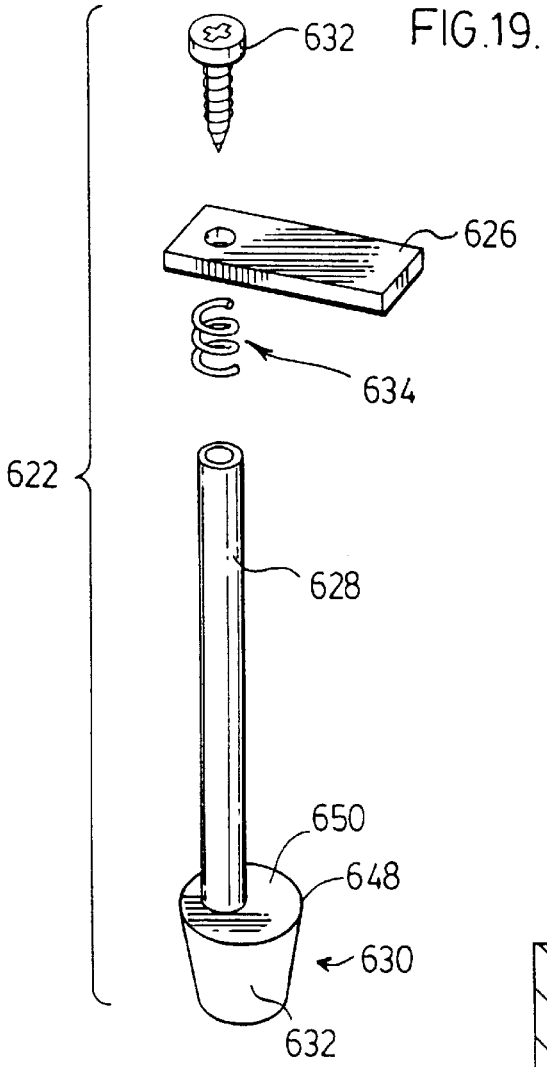
FIG.19.
FIG. 20.
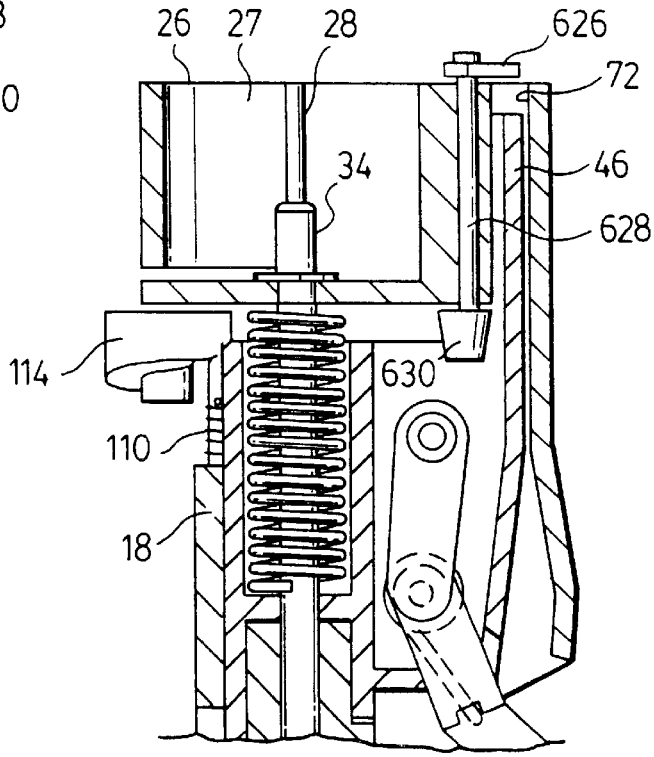

LOCKABLE TELESCOPING SCREWDRIVER

PRIORITY CLAIM

This application claims the priority of international application PCT/CA98/00432, filed Apr. 24, 1998, and is a continuation-in-part of the priority of U.S. application Ser. No. 08/741,278 filed Oct. 30, 1996 now U.S. Pat. No. 5,855,151.

SCOPE OF THE INVENTION

This invention relates generally to a screwdriver for driving collated screws which are joined together in a strip, and, more particularly, to a power screwdriver with a slide body which extends and retracts in driving collated screws and which can be maintained in a retracted position.

BACKGROUND OF THE INVENTION

Collated screwstrips are known in which the screws are connected to each other by a holding strip of plastic material. Such strips are taught, for example, by U.S. Pat. No. 4,167,229 issued Sep. 11, 1979 and its related Canadian Patents 1,040,600 and 1,054,982 as well as U.S. Pat. No. 4,930,630, the disclosures of which are incorporated herein by reference. Screws carried in such screwstrips are adapted to be successively incrementally advanced to a position in alignment with and to be engaged by a bit of a reciprocating, rotating power screwdriver and screwed into a workpiece. In the course of the bit engaging the screws and driving it into a workpiece, the screw becomes detached from the plastic holding strip leaving the strip as a continuous length.

In the use of such collated screwstrips in screwdrivers, the strip serves a function of assisting in guiding the screw into a workpiece and, to accomplish this, the holding strip is retained against movement towards the workpiece. In the screwstrip, each screw to be driven has its threaded shaft threadably engaged in a threaded sleeve of the holding strip such that on the screwdriver engaging and rotating each successive screw, the screw turns within the sleeve which acts to guide the screw as it moves forwardly into threaded engagement into the workpiece. Preferably, only after the tip of the screw becomes engaged in the workpiece, does the head of the screw come into contact with the sleeves. Further, forward movement of the screw into the workpiece then draws the head downwardly to engage the sleeve and to rupture the sleeve by reason of the forward movement of the head with the strip retained against movement towards the workpiece. The sleeve preferably is configured to have fragile straps which break on the head passing through the sleeve such that the holding strip remains intact as a continuous length. Since the holding strip is a continuous length, on advancing the screwstrip with each successive screw to be driven, it necessarily results that portion of the holding strip from which each screw has been driven are also advanced to exit from the power screwdriver.

Known power screwdrivers for driving such collated screwstrips include U.S. Pat. No. 4,146,071 to Mueller et al, issued Mar. 27, 1976, and U.S. Pat. No. 5,186,085 to Monacelli, issued Feb. 16, 1993, the disclosure of which are incorporated herein by reference. Such known power screwdrivers include a rotatable and reciprocally moving screwdriver shaft which is turned in rotation by an electric motor. A screwdriving bit forms a forwardmost portion of the shaft for engaging the head of each successive screw as each screw is moved into a driving position, axially aligned under the screwdriver shaft.

Known power screwdrivers for collated screwstrips suffer the disadvantage appreciated by the applicant that they are dedicated to drive collated screws. In use, they cannot be used to drive separate screws or to withdraw misdriven screws or other screws which are desired to be removed. Known power screwdrivers for collated screwstrips also suffer the disadvantage that it is difficult to engage and change bits mounted to the front end of the drive shaft.

SUMMARY OF THE INVENTION

To at least partially overcome these disadvantages of previously known screwdrivers, the present invention provides a power screwdriver for collated screwstrips which may be latched or locked in a retracted position for use as a normal power screwdriver so as to drive separate screws and/or to withdraw screws and the like independently of the collated screwstrip.

An object of the present invention is to provide a power screwdriver adapted for driving collated screws which may be latched in an extension limiting position in which the screwdriver may be used independently of the collated screwstrip.

Another object is to provide a screwdriver for collated screws which permits latching in a position for use as a screwdriver with or without the collated screwstrip engaged in the screwdriver assembly.

Another object is to provide a screwdriver for collated screwstrips which may be latched in a position permitting access to the drive shaft and/or bit for facilitating removal and/or changing of the bit and/or to permit manual engagement with the bit of screws separate from the collated screwstrip.

Accordingly, the present invention provides a power screwdriver attachment for driving collated screws having a housing and a slide body movable between extended and retracted positions to drive screws from a collated screwstrip, a latching system to releaseably latch the slide body in an extension limiting position in which the power driver is able to be used as a power screwdriver independent of the collated screwstrip. The screwdriver attachment may be used as a power screwdriver for driving or withdrawing screws whether or not a screwstrip is engaged in the attachment. When latched, the screwdriver attachment permits the collated screwstrip to be withdrawn or inserted and, as well, permits the drive shaft to be rotated either forwardly or rearwardly. The screwdriver attachment preferably has a depth adjustment mechanism to adjust the extent to which any screw is driven into a workpiece and which mechanism remains operative when the attachment is latched in the extension limiting position. In the extension limiting position, a bit carried on a forward end of a driver shaft is preferably accessible for manual engagement of separate screws thereon to permit driving or removal of such separate screws with the power screwdriver attachment. The latching system preferably is readily manually accessible to a person using the power tool.

The construction of the screwdriver is preferably compact and lightweight. A compact design may be achieved by camming portions of the slide body extending within the housing rearwardly past the coupling of the housing to the power driver. A lightweight design utilizes lightweight synthetic plastic and nylon materials to comprise major portions of the element.

In one aspect, the present invention provides an apparatus for driving with a power driver a screwstrip comprising threaded fasteners such as screws or the like, which are joined together in a strip comprising:

a housing;

an elongate drive shaft for operative connection to a power driver for rotation thereby and defining a longitudinal axis;

a slide body coupled to the housing for displacement parallel to the axis of the drive shaft between an extended position and a retracted position;

a spring biasing said slide body forwardly relative to the housing parallel to the axis to the extended position;

screw feed advance mechanism to engage the screwstrip and successively, incrementally advance screws on the screwstrip to be axially in alignment with said drive shaft for driving of the screws by the drive shaft, and the screw feed advance mechanism coupled between the slide body and the housing whereby displacement of the slide body relative the housing between the extended position and the retracted position activates the screw feed advance mechanism to advance successive screws;

an extension limit mechanism activatable to releasably prevent the housing and slide body from being extended relative each other towards the extended position beyond an extension limit position. The extension limit mechanism may, in one aspect, lock the housing and slide body together against relative movement. Preferably, the slide body has a guide channel mechanism for said screwstrip extending through the slide body, a guide mechanism to locate successive of the screws advanced via the guide channel to be axially in alignment with said drive shaft for engagement in driving of the screws from the guide mechanism by the drive shaft, and screw feed advance mechanism to engage the screwstrip and successively, incrementally advance screws on the screwstrip through the guide channel mechanism.

BRIEF DESCRIPTION OF THE DRAWINGS

Further aspects and advantages of the present invention will appear from the following description taken together with the accompanying drawings, in which:

FIG. 8 is a schematic cross-sectional view of the driver attachment of FIG. 7 along lines 8—8' and with the nose portion removed;

FIGS. 9, 10 and 11 are respectively, side, top and front views of the latch member shown in FIG. 8;

FIG. 12 is an enlarged cross-sectional view of the housing alone as seen along line 8—8' of FIG. 7 in the absence of the other components;

FIG. 13 is an enlarged side view of the righthand side of FIG. 8, however, showing the housing alone;

FIG. 19 is a schematic pictorial exploded view of the lock mechanism shown in FIG. 18; and FIG. 20 is a partial view of the embodiment of FIG. 16 in a fully retracted position identical to that in FIG. 18 except showing the locking mechanism in an unlocked position.

DETAILED DESCRIPTION OF THE DRAWINGS

Figure 1:
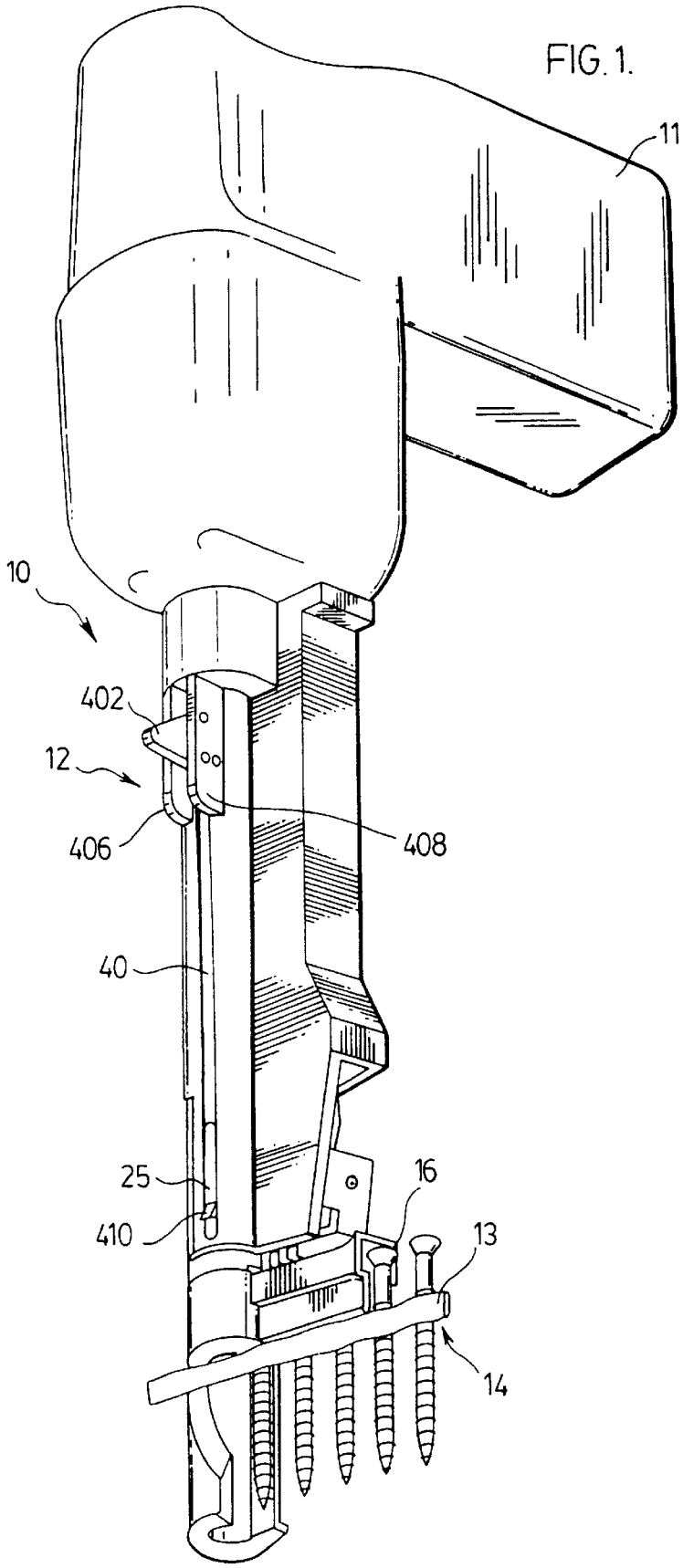
FIG. 1 is a pictorial view of a power screwdriver in accordance with a first embodiment of the present invention.

Reference is made to FIG. 1 which shows a complete power screwdriver assembly 10 in accordance with the present invention. The assembly 10 comprises a power driver 11 to which a driver attachment 12 is secured. The driver attachment 12 engages a collated screwstrip 14 with spaced screws 16 to be successively driven.

Figure 2:
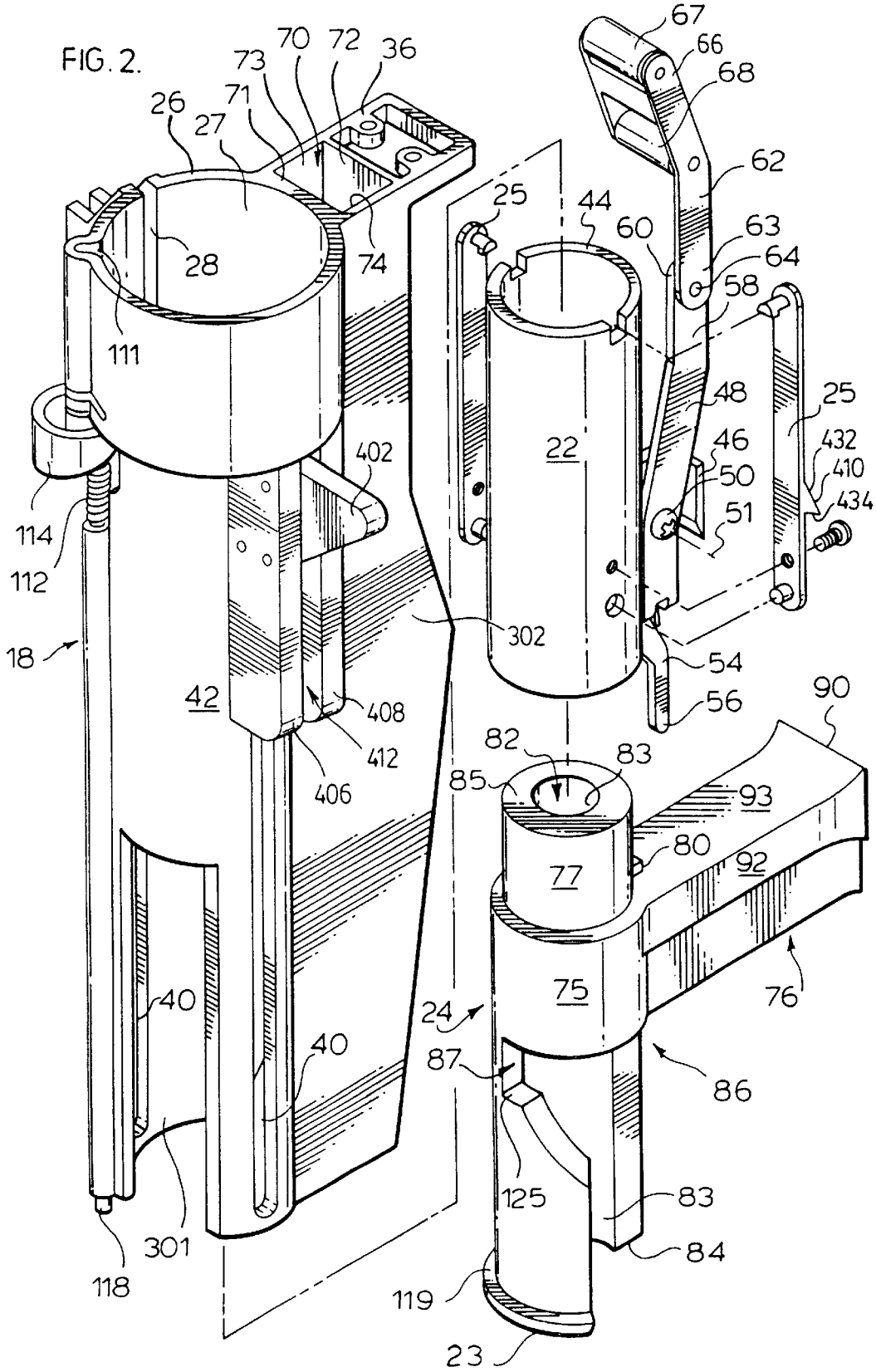
FIG. 2 is an exploded pictorial view of the housing and slide body shown in FIG. 1.
Figure 4:
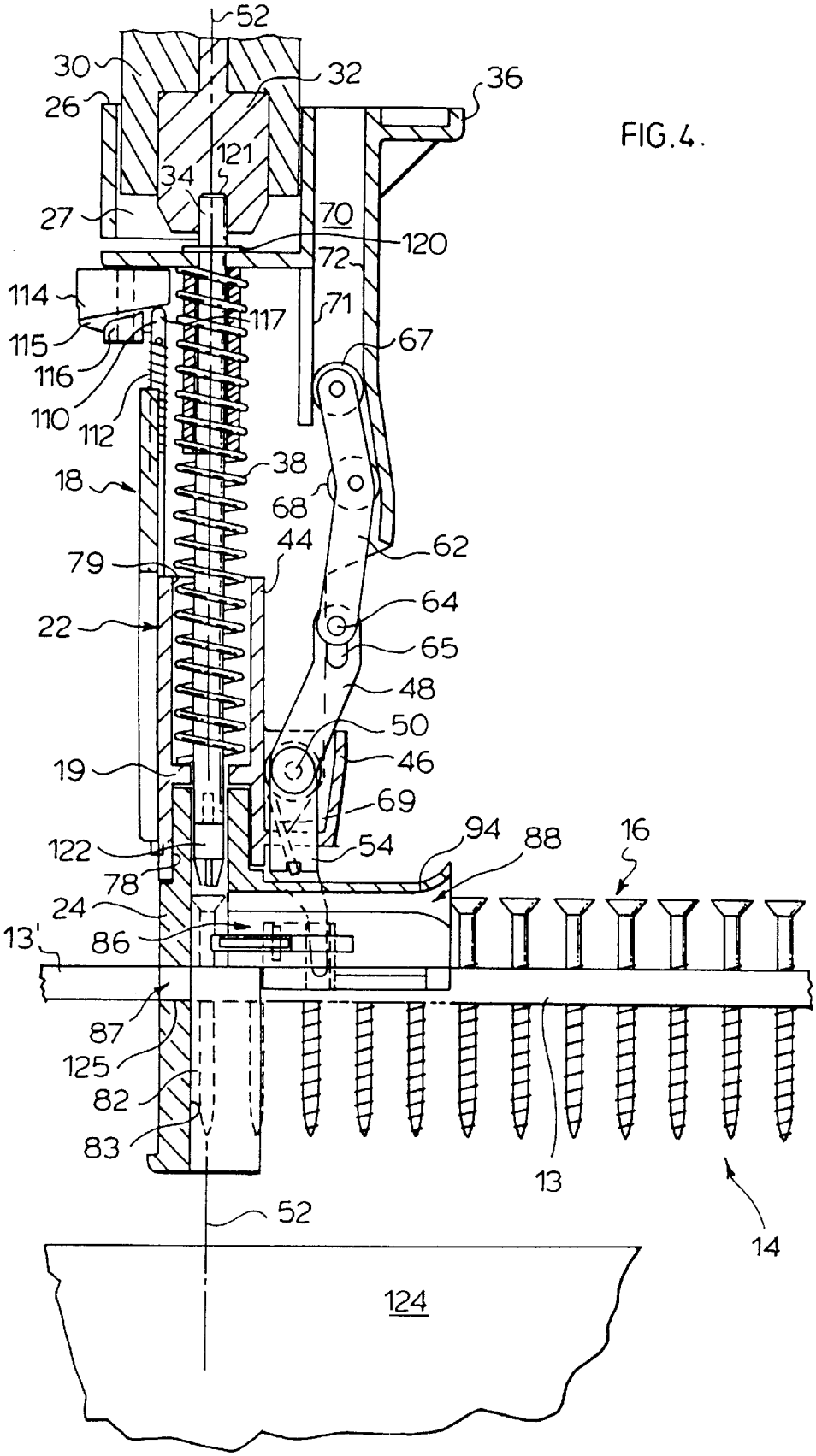
FIG. 4 is a schematic partially cross-sectional view of the driver attachment of FIG. 1 in a fully extended position as seen in FIG. 1 through a plane passing through the longitudinal axis of the drive shaft and centrally of the screws in the screwstrip.
Figure 5:
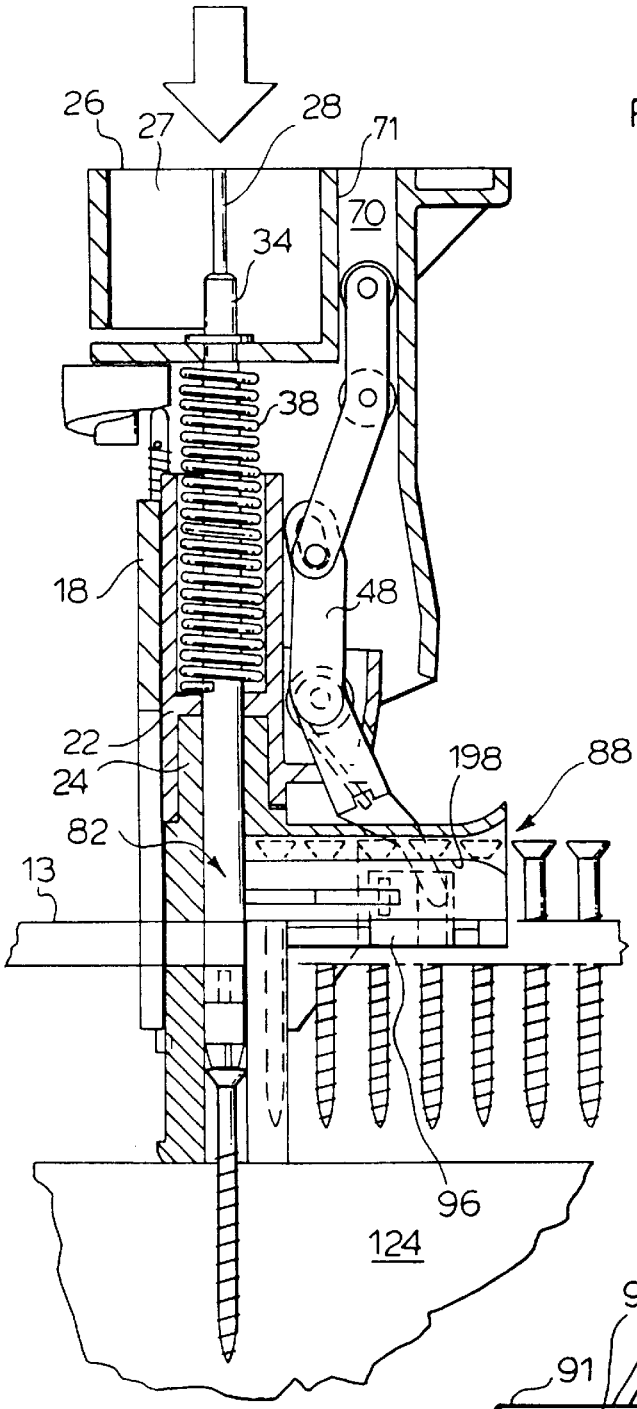
FIG. 5 is a view identical to FIG. 4 but with the driver attachment in a partially retracted position in driving a screw into a workpiece.

Reference is made to FIG. 2 showing an exploded view of major components of the driver attachment 12 as housing 18 and a slide body comprising a rear portion 22 and a removable nose portion 24. FIGS. 4 and 5 show in cross-section the interaction of these components.

As seen in FIG. 4, the rearmost end 26 of the housing 18 has a rearwardly directed socket 27 with a longitudinal slot 28 in its side wall to receive and securely clamp the housing 18 onto the housing 30 of the power driver 11 so as to secure the housing 18 of the driver attachment to the housing 30 of the power driver against relative movement. The power driver 11 has a chuck 32 rotatable in the driver housing 30 by an electric motor (not shown). The chuck 32 releasably engages the driver shaft 34 in known manner. The housing 18 is provided with an optional lateral flange 36 at its rear end to which a known screwstrip containing cartridge (not shown) may be secured in a conventional manner if a screwstrip in the form of a coil is desired to be utilized. It is preferred, however, to utilize screwstrips as shown in the form of discrete, self-supporting strips which are preferably straight.

As seen in FIG. 4, the slide body 20 is slidably received in the housing 18 with the driver shaft 34 received in a bore passing through the rear portion 22 and nose portion 24 of the slide body 20. A compression spring 38 disposed between the housing 18 and the rear portion 22 coaxially about the driver shaft 34 biases the slide body away from the housing 18 from a retracted position towards an extended position. As shown, the spring 38 is disposed between the housing 18 and the rear portion 22. Slide stops 25, best shown in FIG. 2, are secured to the rear portion 22 of the slide body. Two slide stops 25 slide in two longitudinal slots 40 on each side of the part cylindrical side wall 42 of the housing 18 to key the rear portion 22 of the slide body to the housing 18 against relative rotation and to prevent the slide body being moved out of the housing 18. The slide stops 25 are slidable in the longitudinal slots 40 and engage either end of the slots 40 to limit relative sliding of the slide body 20 and housing 18 between a fully retracted position and a fully extended position.

As will be described in greater detail, the slide body 20 is adapted to receive a collated screwstrip 14, to successively advance the screwstrip 14, and to position and drive successive screws from the screwstrip in a cycle of extension and retraction of the slide body 20 relative the housing 18.

Reference is made to FIGS. 1, 2 and 8 to 13 which show a latching system adapted to latch the slide body 20 relative the housing 18 against extension towards the extended position past an extension limit position. The latching system comprises a latch member 402 mounted between two support flanges 406 and 408 preferably integrally formed with the housing 16. Latch member 402 is adapted to releasably couple with a catch member 410 formed on one of the slide stops 25.

Support flanges 406 and 408 extend generally, radially outwardly and axially along housing 18 on either side of the slot 40 so as to define an axially and radially extending slot 412 therebetween opening radially inwardly into slot 40.

Latch member 402 is pivotally mounted within the slot 412 by pivot pin 414 which extends between the flanges 406 and 408 through apertures in each of the flanges and through an aperture 416 in the latch member 402. Latch member 402 is pivotable between an activated position shown in solid lines in FIG. 8 and an inactivated position shown in dashed lines in FIG. 8. The latch member 402 carries two semicircular bosses 418 and 420, one on each side thereof. Each flange 406 and 408 has two spaced circular openings 422 and 424 each sized to receive a respective one of the bosses 418 and 420. On each side, a boss 418 or 420 is to either locate in an opening 424 to retain the latch member 402 in the activated position or in an opening 422 to retain the latch member 402 in the inactivated position. The bosses 418 and 420 and the openings 422 and 424 cooperate to limit movement between the activated and inactivated positions and to bias the bosses to assume the closest of the two positions, preferably due to the inherent resiliency of the flanges. The area between the opening 422 and 424 preferably is, at least partially, cut-away.

Latch member 402 has an engagement portion 426 which extends radially beyond the flanges 406 and 408 for engagement manually by a user to move the latch member 402 between the activated position and the inactivated position.

The latch member 402 has a forwardly extending resilient arm 428 carrying a rearwardly directed hook 430. One of the stop slides 25 is shown to have a catch member 410 formed as a rib-like protrusion which extends radially into the slot 412 between the flange members 406 and 408 to be axially slidable therein upon reciprocal, relative sliding of the slide body 20 and the housing 18. Catch member 410 has a tapering rearwardly directed cam surface 432 and a forwardly directed catch shoulder 434 as best seen in FIG. 2.

FIG. 8 shows the slide body 20 and the housing 18 in an extension limit position in which with the latch member 402 is in an activated position and its hook 430 is engaged on catch shoulder 434 of the catch member 410 to prevent the relative extension of the slide body relative the housing, that is, towards the extended position. From positions in which the slide body 20 is extended forward of the housing relative the extension limit position, the latched condition shown in FIG. 8 may be attained by placing the latch member 402 in the activated position and then retracting the slide body 20 relative the housing 18 past the extension limit position. On rearward movement of the slide body 20, with respect to the housing 18 a forward cam surface 436 of the hook 430 engages the rear cam surface 432 of the catch member 410 and the flexible arm 428 deflects radially outwardly to pass over the catch member 410 and subsequently snap into engagement forward of the catch shoulder 434 with a surface 438 of the hook 430 to engage catch shoulder 434 and to prevent forward extension of the slide body. The forces required to flex arm 428 are less than that required to shift the latch member 402 from the activated to the inactivated position.

To release the hook 430 from catch member 410, due to the flexibility of the arm 428, a user must first apply pressure to retract the slide member 20 rearwardly relative of the housing. With the slide member retracted rearwardly from the extension limit position, the catch member 410 may then be moved by manual application of forces onto the engagement portion 426 to place the latch member 402 in the inactivated position.

When the latch member is in the inactivated position, the hook member 430 and the catch member 410 do not engage each other and, thus, do not impede extension or retraction of the slide body 20 relative the housing 18.

Figure 7:
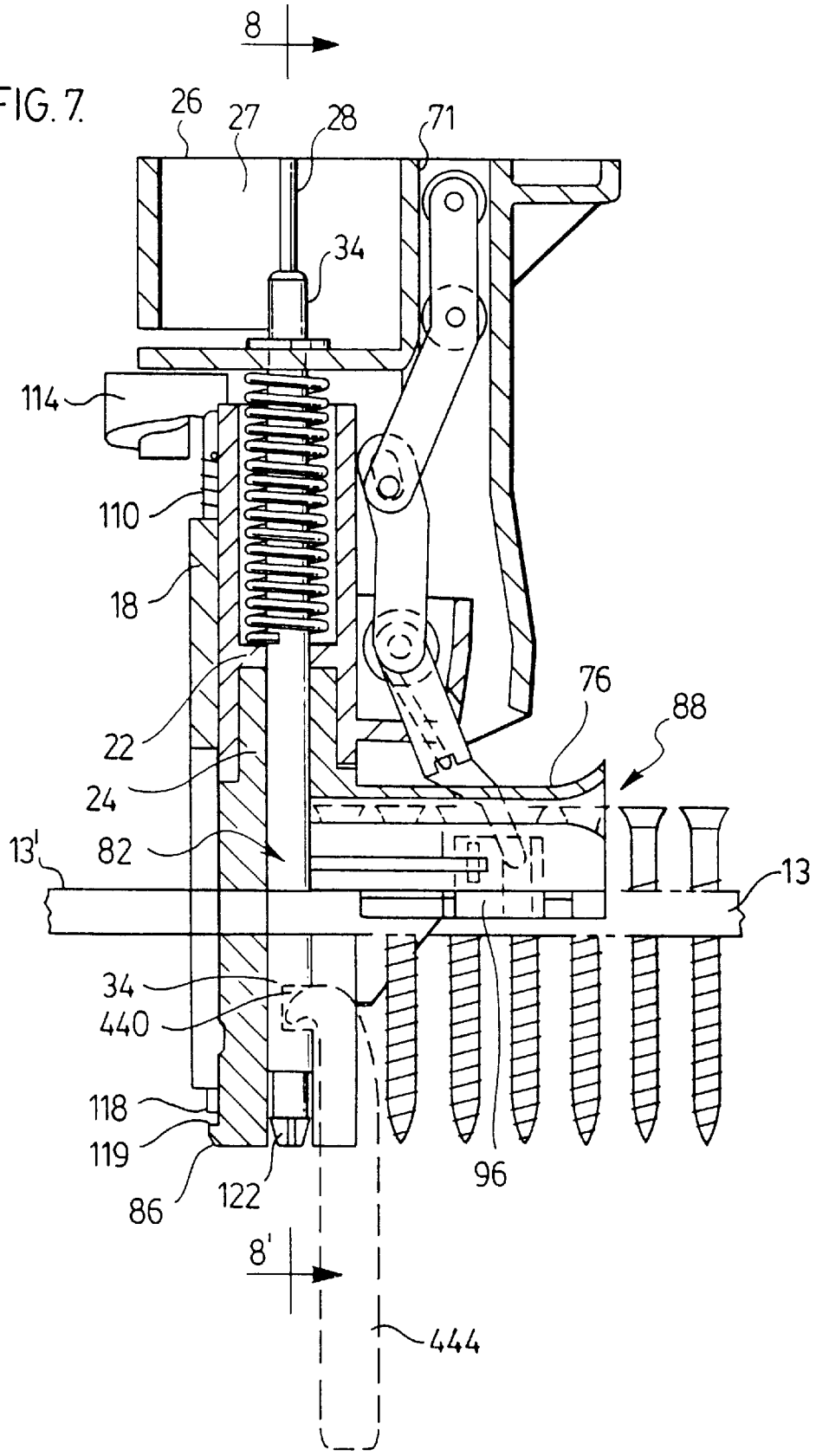
FIG. 7 is a view identical to FIG. 4 but with the driver attachment in a more retracted, extension limit position.

Reference is made to FIG. 7 which shows the screwdriver attachment in the extension limit position. In this position, the drive shaft 34 is free to be rotated by the power driver. As to be described in greater detail, an adjustable depth stop mechanism remains operative. The depth stop mechanism comprises an elongate rod 110 which is axially slidable relative the side wall of the housing 18 parallel the longitudinal axis of the drive shaft. A depth setting cam member 114 may be positioned to set the extent to which the rod 110 may slide rearwardly such that the front end 118 of the rod 110 may be engaged by an annular stop surface 119 provided on the nose portion 24 of the slide body and thereby prevent the slide body 20 from retracting relative the housing 18 beyond an adjustable retraction limit position. With the depth stop mechanism remaining operative, the extent to which the slide body 20 may retract may be set to provide a desired retraction limit position at the retracted position or at a distance therefrom towards the extended position.

In the extension limit position shown in FIGS. 7 and 8, the latched driver attachment can be used as a screwdriver independently of the collated screwstrip and with or without the collated screwstrip maintained in engagement within the slide body. As seen in FIG. 7, in the extension limit position, the bit 122 carried on the front end of the driver shaft 34 is proximate the forward end of the nose portion. A separate screw may manually be placed by a user wish the head of the screw in engagement with the bit 122 and the bit may then be driven by rotating the drive shaft 34 with the power driver 11 is in the manner with a normal screwgun. In that the depth stop mechanism remains operational, the depth stop mechanism can be used to set the depth to which this separate screw is driven. For example, the slide body 20 is capable of retraction from the extension limit position to the retraction limit position, if they are different, while the latch member remains activated.

The drive shaft 34 extends past the spent screwstrip 13' and is free to rotate with the screwstrip left in place as may, for example, be desired to drive and/or to remove but a few screws. Alternately, the screwstrip 13 may be manually withdrawn while the attachment is latched in the extension limit position. By way of example, in use in driving collated 1¼ inch (3.2 cm) drywall screws for securing drywall, circumstances may arise where one or more different screws, for example, of 1¾ inch (4.5 cm) length may be desired to be used. With the latching system, a user need only secure the attachment into a latched configuration in order for the user to then drive one or more longer screws by manually engaging each of the screws to be driven onto the end of the bit. Similarly, while using the attachment as to delve screws from a screwstrip, it is desired that a screw be withdrawn, the attachment may be latched in the extension limit position, the bit positioned over the screw to be withdrawn and the direction of rotation of the power driver reversed to withdraw the screw.

Latching of the attachment in the extension limit position may also be advantageous for removal of a removable bit 122 from he drive shaft 34. With the attachment in the extension limit position and with the screwstrip removed, the bit is accessible not only axially from the front end of the nose portion 24 but also radially via the radially extending screw access opening 86 which aligns with and is received within the radially extending opening in the housing 18 into which the screw feed channel element 76 is axially slidable. Thus, with the attachment latched in the extension limit position, the bit 122 and/or the driver shaft 34 are accessible for changing of the bit. FIG. 8 schematically shows the bit 122 as removably secured to the driver shaft 34 against rotation by a rearward extension 439 of the bit extending into a forwardly opening axial socket 441 in the driver shaft with a split ring retaining the bit in the socket such that the bit can be removed by applying axially directed forward forces on the bit. A slot 440 extends radially into the driver shaft rearward of the bit and opening into the socket 441 such that a lever tool 444 as illustrated in broken lines in FIG. 7 may have its end inserted radially into the slot 440 to be used to apply forwardly directed surfaces to the rear of the bit 122 to remove the bit from the driver shaft. Such an assembly for a socket to receive the bit and a lever tool for removal of the bit are described in the applicant's International Application PCT/CA94/00209, published Oct. 27, 1994 the disclosure of which is incorporated herein by reference. With the driver attachment locked in the extension limit position as shown in FIGS. 7 and 8, the slot 440 is readily accessible for insertion of the tool 444 radially through both the housing and through the opening 86 in the nose portion. As may be seen, the housing and the nose portion both have radially directed slots in the same side which are complementary in the sense that when the housing and slide body are proximate the retracted position, they provide radial access to the driver shaft as is particularly useful for ingress and exit of the lever tool. With the driver shaft free to rotate, the slot 440 can be disposed to open into the opening 86 for engagement by the lever tool. Preferably, the screwstrip would be totally or partially removed from the nose portion before using the lever tool 444.

Only one arrangement has been illustrated for relative latching of the housing 18 and the slide body 20. It is to be appreciated that many different latching arrangements can be provided to couple the housing and the slide body against extension past an extension limit position. Such latching system may be manually or electromechanically operated. Preferably, a mechanism for activation and release of the latching mechanism may be readily accessible to a person using the tool as in the case with the engagement portion 426 which is readily accessible to either one of the hands of a person operating the power driver.

In the preferred embodiment illustrated, the extension limit position is shown as preferably proximate the retracted position and may, in fact, be the retracted position. When the extension limit position is the retracted position, the housing and slide body are locked together against relative movement. The extension limit position is preferably between the retracted position and the extended position. The attachment could be arranged such that a retracted position in which retraction of the slide body in driving of screws from a collated screwstrip is stopped in normal operation is not a fully retracted position and the extension limit position could be provided to be more retracted than such a normal retracted position. Having the capability of latching the slide body in a position more retracted than a normal retracted position might be advantageous, for example. to have the bit in the fully extended position extend forwardly from the front of the guide tube as, for example, to assist in manually placing a screw on the bit and/or for engagement of the drive shaft 34 and bit 122 as for removal of a bit threadably engaged in the driver shaft. The depth stop mechanism may need to be modified to accommodate an extension limit position beyond the normal retracted position.

The illustrated embodiment shows one catch member 410 provided on slide stop 25. It is appreciated that the slide stop 25 could carry two or more catch shoulders to permit latching at different extension limit positions.

The illustrated embodiment shows but one form of a mechanism to releasably prevent the housing and slide body from sliding relative each other. Many other embodiments could be provided. For example, another embodiment is a clamp mechanism adapted to be manually operated and to clamp the housing to the slide body to lock each against relative movement. A simple clamp could be carried in a threaded manner on the slide stop 25 of the slide body 20 extending outwardly therefrom with an enlarged head to overlie the housing 18 and to frictionally clamp through the slot 40 of the housing 18 onto the housing 18 as when the head is manually turned in one direction and for release by manual turning in the other direction. Such a clamp for locking the housing relative the slide body could be provided between many different interacting parts of the slide body and housing and, preferably, could be activated to lock the slide body in the fully retracted position.

Additional features of the driver attachment and the interaction of its components is now described with reference to the remaining figures which show the slide body as comprising a rear portion 22 and a removable nose portion 24. It is to be appreciated that the latching system described is equally operative with a slide body in which the nose portion 24 is not removable as with the rear portion and nose portion 24 being an integral element.

The rear portion 22 comprises a generally cylindrical element 44 with a radially extending flange element 46 on one side. A lever 48 is pivotally mounted to the flange element 46 by bolt 50 for pivoting about an axis 51 of bolt 50 normal to a longitudinal axis 52 which passes centrally through the drive shaft 34 and about which the drive shaft is rotatable. Lever 48 has a forward arm 54 extending forwardly to its front end 56 and a rear arm 58 extending rearwardly to its rear end 60. A cam follower 62 has its forward end 63 mounted to the rear end 60 of the rear arm 58 by a bolt 64 being received in a slot 65 extending longitudinally in the rear end of the rear arm 58. The cam follower 62 has at its rear end 66 two cam rollers 67 and 68 rotatable on pins parallel to the axis of bolts 50 and 64.

As seen in FIGS. 2 and 4, the housing 18 carries a camming channel 70 in which the cam rollers 67 and 68 are received. The camming channel 70 is disposed to one side of the driver shaft 34 and extends generally parallel thereto. The camming channel 70 has opposed camming surfaces 71 and 72 at least partially closed by side walls 73 and 74.

The camming channel 70 extends rearwardly beside the socket 27 of housing 18 and thus rearwardly past the chuck 32 of the power driver 11 to one side thereof. This configuration permits the use of a housing 18 which is of a lesser length parallel longitudinal axis 52.

A spring 69 wound about bolt 50 is disposed between the flange element 46 and the forward arm 54 of the lever 48 to bias the lever in a clockwise direction as seen in FIG. 4. The effect of spring 69 is to urge the cam roller 67 into engagement with cam surface 71 and to urge cam roller 68 into engagement with cam surface 72.

With relative sliding of the slide body 20 and the housing 18 between the extended and the retracted positions, the cam follower 62 translates the relative movement and positioning of the slide body 20 and housing 18 into relative pivoting and positioning of the lever 48 about the axis 51. The ability of bolt 64 to slide longitudinally in the longitudinal slot 65 provides a lost motion linkage as is known and is advantageous such that the relative timing of pivoting of the lever 48 varies as compared to the relative location of the slide body 20 and housing 18 in moving towards an extended position as contrasted with moving towards a retracted position.

The nose portion 24 has a generally cylindrical screw guide element or guide tube 75 arranged generally coaxially about longitudinal axis 52 and a flange-like screw feed channel element 76 extending radially from the guide tube 75.

The guide tube 75 has a cylindrical portion 77 at its rear end with a cylindrical exterior surface sized to be closely received, preferably in a friction fit within a forwardly opening cylindrical bore 78 in the forward end of the rear portion 22. A radially extending key 80 is provided to extend from the cylindrical portion 77 of the nose portion 24 to be received in a correspondingly sized keyway slot in in the rear portion 22 as best seen in FIGS. 4 and 7 to secure the nose portion 24 to the rear portion 22 against relative pivoting about the longitudinal axis 52.

The guide tube 75 has a cylindrical bore or guideway 82 extending axially through the guide tube with the guideway 82 delineated and bordered by a radially extending cylindrical side wall 83 and open at its forward axial end 84 and at its rearward axial end 85.

The guide tube 75 has a rearward section adjacent its rear end 85 in which the side wall 83 extends 360° about the guideway 82. Forward of the rearward section, the guide tube has a forward section best seen in FIG. 4 and which has an access opening 86, shown in the drawings as being on the right hand side of the guide tube 75. Screw access opening 86 is provided to permit the screwstrip 14 including retaining strip 13 and screws 16 to move radially inwardly into the guideway 82 from the right as seen in FIGS. 4 and 5. Each screw preferably has a head 17 with a diameter marginally smaller than the diameter of the side wall 83. It follows that where the head of the screw is to enter the guideway 82, the screw access opening must have circumferential extent of at least 180°. Where the shank 208 of the screw is to enter the guideway, the screw access opening may have a lesser circumferential extent.

In the forward section, the side wall 83 of the guide tube 75 engages the radially outermost periphery of the head 17 of the screw 16, to axially locate the screw head 17 coaxially within the guideway 82 in axial alignment with the drive shaft 34. In this regard, the side wall 83 preferably extends about the screw sufficiently to coaxially locate the screw head and thus preferably extend about the screw head at least 120°, more preferably, at least 150° and most preferably about 180°.

An exit opening 87, shown towards the left hand side of the guide tube 75 in FIGS. 4 and 5, is provided of a size to permit the spent plastic strip 13 from which the screws 16 have been driven to exit from the guideway 82. Forwardly of the exit opening 87, the side wall 83 of the guide tube 75 is shown as extending greater than about 180° about the longitudinal axis 52 so as to continue to provide a side wall 83 which can assist and positively coaxially guide the head 17 of a screw 16 being driven.

Figure 3:
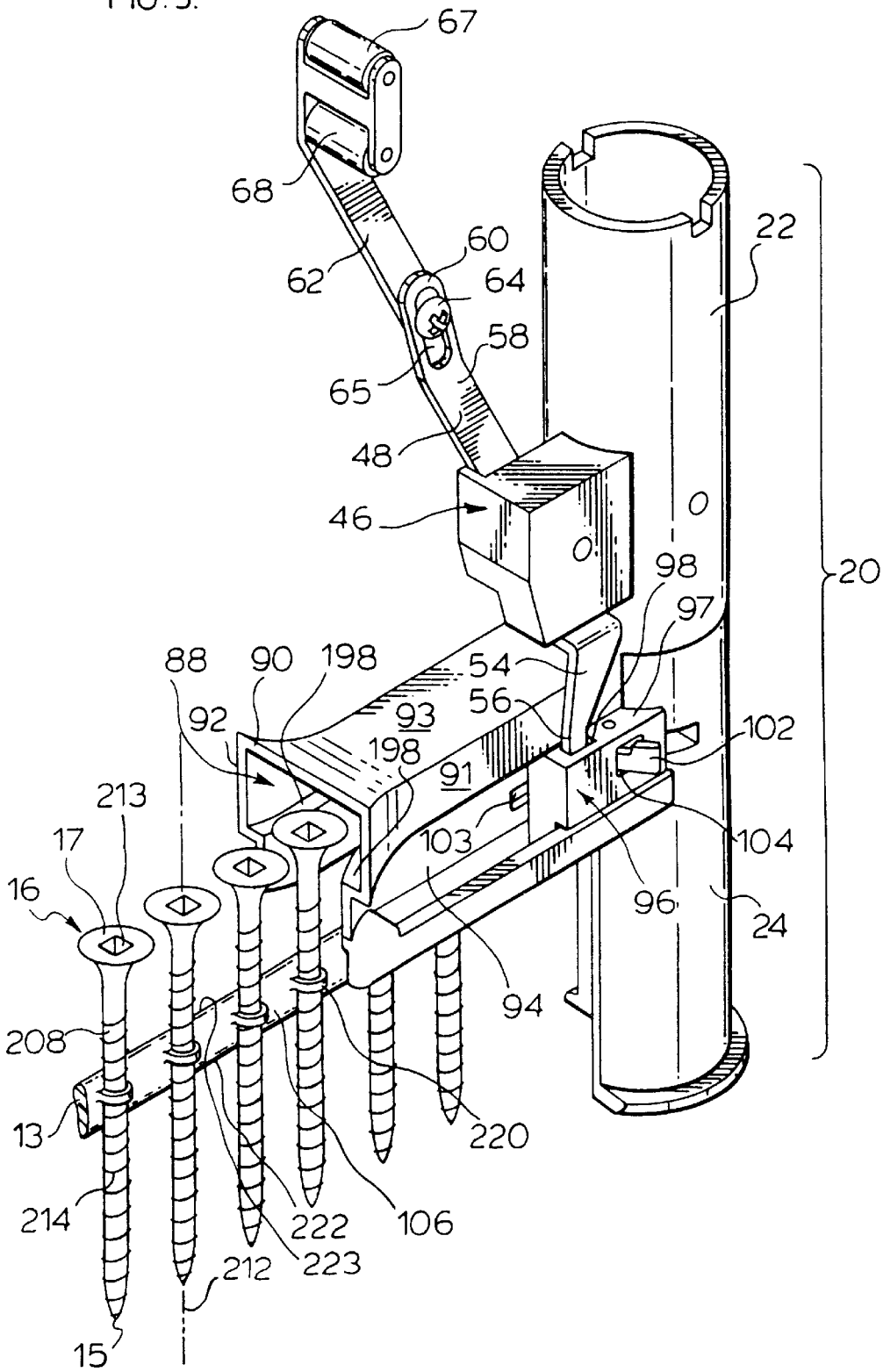
FIG. 3 is a pictorial view of the opposite side of the slide body to that shown in FIG. 2 but with a screwstrip positioned therein.

The screw feed channel element 76 is best seen in FIGS. 3 and 4 as providing a channelway 88 which extends radially relative the longitudinal axis 52 to intersect with the guideway 82 in the guide tube 75. In this regard, the channelway 88 opens into the guideway 82 forming the screw access opening 86. The channelway 88 provides a channel of a cross-section similar to that of the screw access opening 86 from the screw access opening 86 to a remote entranceway opening 90. The channelway 88 is defined between two side walls 91 and 92 joined by a top wall 93. The major side wall 91 is shown as extending from the heads 17 of the screws 16 forwardly to at least partially behind the plastic retaining strip 13. The lesser side wall 92 is shown as extending from the heads 17 of the screws 16 forwardly to above the plastic strip 13. The side walls 91 and 92 define the channelway 88 with a cross-section conforming closely to that of the screwstrip 14 and its strip 13 and screws 16 with an enlarged width where the heads of the screws are located and an enlarged width where the retaining strip 13 is provided about the screws. The side walls 91 and 92 also have an enlarged funnelling section at the entranceway opening 90 which tapers inwardly to assist in guiding the screwstrip to enter the channelway.

As best seen in FIG. 3, the major side wall 91 is provided on its exterior back surface with a raceway 94 extending parallel the channelway 88 and in which a shuttle 96 is captured to be slidable towards and away from the guide tube 75 between an advanced position near the guide tube and a withdrawn position remote from the guide tube. The shuttle 96 has a rear surface 97 in which there is provided a rearwardly directed opening 98 adapted to receive the front end 56 of the forward arm 54 of lever 48 so as to couple the shuttle 96 to the lever 48 for movement therewith.

Figure 6:
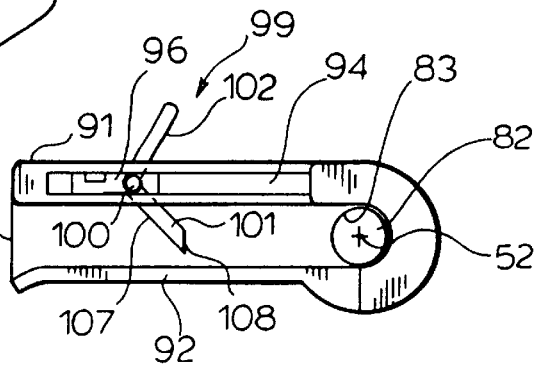
FIG. 6 is an end view of the nose portion of FIG. 2.

Shuttle 96 carries a pawl 99 to engage the screwstrip 14 and with movement of the shuttle 96 to successively advance the strip one screw at a time. As seen in FIG. 6, the shuttle 96 has a fixed post 100 on which the pawl 99 is journalled about an axis parallel the longitudinal axis 52 about which the driver shaft 34 rotates. The pawl 99 has a strip pusher arm 101 which extends through a slot 103 in the major side wall 91 to engage and advance the screwstrip. The pawl 99 has a manual release arm 102 away from pusher arm 101 and which extends out through a slot 104 in the shuttle 99. A torsional spring is disposed about post 100 between pawl 99 and shuttle 96 and urges the pusher arm 101 clockwise as seen in FIG. 6. The spring biases the pusher arm 101 into the screwstrip 14. The engagement of release arm 102 on the right hand end of slot 104 limits the pivoting of the pawl 99 clockwise to the position shown in FIG. 6.

The pusher arm 101 of the pawl 99 has a cam face 107. On the shuttle moving away from the guide tube 75 towards the withdrawn position, i.e., to the left in FIG. 6, the cam face 107 will engage the screws 16 and/or the strip 13 and permit the pusher arm 101 to pivot about post 100 against the bias of spring so that the pusher arm 101 may move with the shuttle to the left.

The pusher arm 101 has an engagement face 108 to engage the screws 16 and/or strip 13. On the shuttle moving towards the guide tube 75 towards the advanced position, i.e., to the right in FIG. 6, the engagement face 108 will engage the screws 16 and/or strip 13 and advance the screwstrip to the right as seen in FIG. 6 so as to position a screw 16 into the guideway 82 in a position to be driven and to hold the screwstrip 14 against movement towards the left.

The release arm 102 permits manual withdrawal of the screwstrip 14. A user may with his finger or thumb manually pivot the release arm 102 against the bias of spring so that the pusher arm 101 and its engagement face 108 is moved away from and clear of the screwstrip 14 whereby the screwstrip may manually be withdrawn as may be useful to clear jams or change screwstrips.

With the nose portion 24 coupled to the rear portion 22, the lever 48 couples to the shuttle 96 with the forward arm 54 of lever 48 received in the opening 98 of the shuttle 96. Sliding of the slide body 20 and the housing 18 in a cycle from an extended position to a retracted position and then back to an extended position results in reciprocal pivoting of the lever 48 about axis 51 which slides the shuttle 96 between the advanced and withdrawn position in its raceway 94 and hence results in the pawl 99 first retracting from engagement with a first screw to be driven to behind the next screw 16 and then advancing this next screw into a position to be driven.

The nose portion 24 is removable from the rear portion 22. The nose portion 24 and rear portion 22 may be coupled together by axially inserting the cylindrical portion 77 of the guide tube 75 into the bore 78 in the rear portion 22 with the key 80 aligned with the keyway slot 82 and with the front end 56 of the forward arm 54 of the lever 48 aligned with the opening 98 in the shuttle 96. Thus, the removable nose portion 24 may be coupled to the rear portion 22 merely by axially aligning the nose portion and the rear portion and moving the two elements together in a direction parallel the longitudinal axis 52.

With the nose portion 24 held on the rear portion 22 by a friction fit. the nose portion 24 can manually be removed by a user merely by the manual application of force. The nose portion 24 is removable from the rear portion 22 without disassembly or uncoupling of any of the remainder of the screwdriver assembly 10. Thus, the nose portion 24 is removable without uncoupling of the rear portion 22 relative any of the housing 18, spring 38, power driver 11, driver shaft 34 or the screw feed activation mechanism comprising amongst other things the lever 48 and cam follower 62 and without uncoupling of the cam follower 62 in camming channel 70 of the housing 18.

The nose portion 24 carries the guide tube 75 with its screw locating guideway 82, the screw feed channel element 76 with its channelway 88, and screw feed advance mechanism with the reciprocating shuttle 96 and pawl 99 to advance the screwstrip 14 via the channelway 88 into the guideway 82. Each of the guideway 82, channelway 88 and shuttle 96 are preferably customized for screwstrips and screws or other fasteners of a corresponding size. In this context, size includes shape, head diameter, shaft diameter, retaining strip configuration, length, spacing of screws along the retaining strip and the presence or absence of washes amongst other things. Different nose portions 24 are to be configured for different screwstrips and screws. The different nose portions 24 are each compatible with the same rear portion 22 and are readily exchangeable so as to permit the driver attachment to be readily adapted to drive different screwstrips and screws.

Many changes can be made to the physical arrangement of the nose portion 24 to accommodate different screws and fasteners. For example, the cross-sectional shape of the channelway 88 can be changed as can the diameter of the guideway 82. The length of the side walls 91 and 92 about the channelway 88 can be varied to accommodate different size screws which may require greater or lesser engagement.

To adjust for different spacing between screws in different screwstrips, the stroke of the shuttle 96 in reciprocating back and forth can be shortened or lengthened by varying the distance from the axis 51 of the lever 48 to where the shuttle 96 engages the forward arm 54 of the lever 48. For example, placing the same shuttle 96 in a raceway 94 spaced further from the axis 51 will increase the length of the stroke of the shuttle 96 for the same arc of pivoting of lever 48. Similarly, using the same shuttle 96 in the same raceway 94 but having the opening 98 in the shuttle 96 to engage the lever 48 farther from the axis 51 will also increase the length of the stroke of the shuttle 96 for the same arc of pivoting of lever 48.

In contrast with the removable nose portion 24 which is intended to be provided in many different replaceable configurations, the remainder of the driver attachment is preferably of a constant unchanged configuration. In this regard, the remainder of the driver attachment may be characterized by the housing 18, rear portion 22 of the slide body 20, drive shaft 34 and spring 38 together with a screw feed activation mechanism comprising the lever 48 cam follower 62 interacting between the rear portion 22 and the housing 18. This screw feed activation mechanism is activated by relative movement of the housing 18 and rear portion 22 and serves to engage and move the screw feed advance mechanism comprising the shuttle 96 and pawl 99 carried on the nose portion 24.

The construction of the housing 18 and slide body 20 provide for a compact driver attachment.

The housing 18 has a part cylindrical portion formed by sidewall 301.

The slide body 20 as best seen in FIG. 3 comprising the rear portion 22 and nose portion 24, has a part cylindrical portion of a uniform radius sized to be marginally smaller than the side wall 301 of the housing 18. The side wall 301 extends circumferentially about the part cylindrical portion of the slide body 20 to retain the slide body 20 therein.

The housing has a flange portion 302 which extends radially from one side of the part cylindrical portion and is adapted to house the radially extending flange 46 of the rear portion 22 and the screw feed activation mechanism comprising the camming channel 70 interacting with the lever 48 and cam follower 62. The flange portion 302 is open at its front end and side to permit the screw feed channel element 76 to slide into and out of the housing 18. Concentrically located about the drive shaft 34 is the spring 38, the part cylindrical portions of the slide body 20, and the part cylindrical portions of the housing 18.

The driver attachment is provided with an adjustable depth stop mechanism which can be used to adjust the fully retracted position, that is, the extent to which the slide body 20 may slide into the housing 18. The adjustable depth stop mechanism is best seen in FIGS. 2 and 3 as comprising an elongate rod 110 slidably received in an elongate open ended bore 111 provided in the side wall 42 of the housing 18 and extending parallel to longitudinal axis 52.

A depth setting cam member 114 is secured to the housing 18 for rotation about a pin 116 parallel the longitudinal axis 52. The cam member 114 has a cam surface 115 which varies in depth, parallel the longitudinal axis 52, circumferentially about the cam member 114. A portion of the cam surface 115 is always axially in line with the rod 110. A spring 112 biases the rod 110 rearwardly such that the rear end 117 of the rod engages the cam surface 115. The spring 112 is disposed between the housing and a pin 112 on the rod. By rotation of the cam member 114, the extent to which the rod 110 may slide rearwardly is adjusted.

The rod 110 has a front end 118 which extends forwardly from bore 111 for engagement with rearwardly directed annular stop surface 119 provided on the nose portion 24 of the slide body. The slide body 20 is prevented from further sliding into the housing 18 when the front end 118 of the rod 110 engages the stop surface 119. The extent the slide body 20 may slide into the housing 18 is determined by the length of the rod 110 and the depth of the cam member 114 axially in line with the rod. The cam member 114 is preferably provided with a ratchet-like arrangement to have the cam member 114 remain at any selected position biased against movement from the selected position and with circular indents or depressions in the cam surface 115 to assist in positive engagement by the rear end 117 of the rod. The cam member 114 is accessible by a user yet is provided to be out the way and not interfere with use of the driver attachment. The nose portion 24 may be customized for use in respect of different size screws by having the location of the stop surface 119 suitably provided axially on the nose portion 24 as may be advantageous for use of different size screws.

The driver shaft 34 is shown in FIGS. 4 and 5 as carrying a split washer 120 engaged in an annular groove near its rear end 121 to assist in retaining the rear end of the driver shaft in the socket 27 of the housing 18. The driver shaft 34 is provided with a removable bit 122 at its forward end which bit can readily be removed for replacement by another bit as for different size screws. Such bits include sockets and the like in any replacement bits will preferably be of an outside diameter complementary to the inside diameter of the guideway 82 in a corresponding replacement nose portion adapted for use with a corresponding sized screws. To accommodate bits of increased diameter over the bit shown in FIGS. 4 and 5, the guideway 82 of the guide tube 75 may be provided with an increased radius, at least commencing at the location where the bit may have an enlarged diameter and extending forwardly therefrom. The guideway 82 in the guide tubes 75 may thus have a step configuration with the side wall 83 being of a reduced diameter where the driver shaft 34 enters the rear of the guide tube 75 and the sidewall 83 may then increase to an enlarged diameter forwardly to accommodate an enlarged bit such as a socket.

The rear portion 22 is shown in FIGS. 4 and 5 as having a radially inwardly extending annular flange 19 which provides the end of the forwardly opening bore 78 as well as the end of a rearwardly opening bore 79 within which the spring 38 is received. The annular flange 19 has an opening therethrough of a diameter slightly larger than the diameter of the driver shaft 34 so as to assist in journalling the driver shaft therein. The opening through the annular flange 19 may however be increased so as to facilitate the use of driver shafts 34 having enlarged diameters as well as a driver shafts 34 having reduced diameters.

Insofar as the driver shaft 34 has a removable bit 122, it is preferred that as shown, when the driver attachment 12 is in the fully extended position and the nose portion 24 is removed, the bit 122 be readily accessible for removal and replacement. In this regard, it is preferred that the nose portion 24 have a guideway 82 of a minimum diameter throughout its length at least equal to the diameter of the bit 122 such that the nose portion 24 may be removed from the rear portion 22 without the need to remove the bit 122 as may otherwise be the case in the event the guideway 82 may have a stepped configuration.

Operation of the driver attachment is now explained with particular reference to FIGS. 4 and 5. As seen in FIG. 4, the screws 16 to be driven are collated to be held parallel and spaced from each other by the plastic retaining strip 13.

In operation, a screwstrip 14 containing a number of screws 16 collated in the plastic retaining strip 13 is inserted into the channelway 88 with the first screw to be driven received within the guideway 82. To drive the first screw into the workpiece 124, the power driver 11 is activated to rotate the driver shaft 34. The driver shaft 34 and its bit 122, while they are rotated, are reciprocally movable in the guideway 82 towards and away from the workpiece 124. In a driving stroke, manual pressure of the user pushes the sousing 18 cowards the workpiece 124. With initial manual pressure, the forward end 23 of the nose portion engages the workpiece 124 to compress spring 38 so as to move slide body 20 relative the housing 18 into the housing 18 from an extended position shown in FIG. 4 to a retracted position. On release of this manual pressures in a return stroke, the compressed spring 38 moves the slide body 20 back to the extended position thereby moving the housing 13 and the driver shaft 34 away from the workpiece.

In a driving stroke, as the driver shaft 34 is axially moved towards the workpiece, the bit 122 engages the screw head 17 to route the first screw to be driven. As is known, the plastic strip 13 is formed to release the screw 16 as the screw 16 advances forwardly rotated by the driver shaft 34. Preferably, on release of the screw 16, the plastic strip 13 deflects away from the screw 16 outwardly so as to not interfere with the screw 16 in its movement into the workplace. After the screw 16 is driven into the workpiece 124, the driver shaft 34 axially moves away from the workpiece under the force of the spring 38 and a successive screw 16 is moved via the screw feed advance mechanism from the channelway 88 through the access opening 86 into the guideway 82 and into the axial alignment in the guideway with the driver shaft 34.

The screw 16 to be driven is held in position in axial alignment with the driver shaft 34 with its screw head 17 abutting the side wall 83 in the guideway 82. As a screw 16 to be driven is moved into the cylindrical guideway 82, a leading portion of the strip 13' from which screws have previously been driven extends outwardly from the guideway 83 through the exit opening 87 permitting substantially unhindered advance of the screwstrip 14.

To assist in location of a screw to be driven within the guide tube 75, in the preferred embodiment the exit opening 87 is provided with a rearwardly facing locating surface 125 adapted to engage and support a forward surface 222 of the strip 13. Thus, on the bit 122 engaging the head of the screw and urging the screw forwardly, the screw may be axially located within the guide tube 75 by reason not only of the head of the screw engaging the side wall 83 of the guideway but also with the forward surface 222 of the strip 13 engaging the locating surface 125 of the exit opening 87. In this regard, it is advantageous that the forward surface 222 of the retaining strip 13 be accurately formed having regard to the relative location of the screws 16 and particularly the location of the their heads 17. The forward surface 222 of the strip 13 may be complementary formed to the locating surface 125 and if desired indexing notches or the like may be provided in the forward surface 222 of the strip 13 to engage with complementary notches or indents on the locating surface 125 of the entranceway to assist in indexing location of the strip 13 relative the locating surface and enhance the location thereby of the screw 16 within the guide tube 75.

In the embodiment of the nose portion 24 shown in FIGS. 1 to 6, on the bit 122 engaging the head 17 of the screw 16 and urging it forwardly in the guideway 82, the strip 13 is preferably held against movement forwardly firstly by the forward surface 222 of the strip engaging locating surface 125 and, secondly. by the under surfaces of the heads 17 of screws in the channelway 88 engaging on the rearwardly directed shoulders provided on each of the side walls 91 and 92 where the enlarged width cross-section of the channelway 88 accommodating the head of the screws reduces in width as seen in FIG. 3. Together with the location of the head 17 of a screw 16 coaxially in the guideway, the screw 16 to be driven is located axially aligned with the driver shaft without any moving parts other than the advance shuttle 96.

The driver attachment 12 disclosed may be provided for different applications. In a preferred application, the driver may be used for high volume heavy load demands as, for example, as in building houses to apply sub-flooring and drywall. For such a configuration, it is preferred that with the power driver 11 comprising a typical screw gun which inherently incorporates a friction clutch and thus to be extent that a screw is fully driven into a workpiece, the clutch will, on the forces require to drive the screw becoming excessive, slip such that the bit will not be forced to rotate an engagement with the screw head and thus increase the life of the bit.

The driver attachment in accordance with the present invention is, however, adaptable for use with conventional power drills which are similar to screw guns yet do not incorporate a clutch mechanism. The driver attachment may be suitably used with a drill without a clutch preferably with the user manipulating the drill and driver attachment in use to reduce the likelihood of bit wear by the bit rotating relative the screw head in a jamming situation.

The driver attachment may be constructed from different materials of construction having regard to characteristics of wear and the intended use of the attachment. Preferably, a number of the parts may be molded from nylon or other suitably strong light weight materials. Parts which are subjected to excessive wear as by engagement with the head of the screw may be formed from metal or alternatively metal inserts may be provided within an injection molded plastic or nylon parts. The provision of a removable nose portions 24 also has the advantage of permitting removable nose portion to be provided with surfaces which would bear the greatest loading and wear and which nose portions may be easily replaced when worn.

The screw feed advance mechanism carried on the nose portion has been illustrated merely as comprising a reciprocally slidable shuttle carrying a pawl. Various other screw feed advance mechanisms may be provided such as those which may use rotary motion to incrementally advance the screws. Similarly, the screws feed activation mechanism comprising the lever 48 and the cam follower have been shown as one preferred mechanism for activating the screw feed advance mechanism yet provide for simple uncoupling as between the shuttle 96 and the lever 48. Other screw feed activation means may be provided having different configurations of cam followers with or without levers or the like.

In the preferred embodiment, the screwstrip 14 is illustrated as having screws extending normal to the longitudinal extension of the strip 13 and in this context, the channelway 88 is disposed normal to the longitudinal axis 52. It is to be appreciated that screws and other fasteners may be collated on a screwstrip in parallel spaced relation however at an angle to the longitudinal axis of the retaining strip in which case the channelway 88 would be suitably angled relative the longitudinal axis so as to locate and dispose each successive screw parallel to the longitudinal axis 52 of the driver shaft.

A preferred collated screwstrip 14 for use in accordance with the present invention is as illustrated in the drawings and particularly FIG. 3 and are substantially in accordance with Canadian Patent 1,054,982. The screwstrip 14 comprises a retaining strip 13 and a plurality of screws 16. The retaining strip 13 comprises an elongate thin band formed of a plurality of identical sleeves interconnected by lands 106. A screw 16 is received within each sleeve. Each screws 16 has a head 17, a shank 208 carrying external threads 214 and a tip 15. As shown, the external threads extend from below the head 17 to the tip 15.

Each screw is substantially symmetrical about a central longitudinal axis 212. The head 17 has in its top surface a recess 213 for engagement by the screwdriver bit.

Each screw is received with its threaded shank 208 engaged within a sleeve. In forming the sleeves about the screw, as in the manner for example described in Canadian Patent 1,040,600, the exterior surfaces of the sleeves come to be formed with complementary threaded portions which engage the external thread 214 of the screw 16. Each sleeve has a reduced portion between the lands 106 on one side of the strip 13. This reduced strength portion is shown where the strip extends about each screw merely as a thin strap-like portion or strap 220.

The strip 13 holds the screw 16 in parallel spaced relation a uniform distance apart. The strip 13 has a forward surface 222 and a rear surface 223. The lands 106 extend both between adjacent screws 16, that is, horizontally as seen in FIG. 3, and axially of the screws 16, that is, in the direction of the longitudinal axes 212 of the screws. Thus, the lands comprise webs of plastic material provided over an area extending between sleeves holding the screws and between the forward surface 222 and the rear surface 223. A land 106 effectively is disposed about a plane which is parallel to a plane in which the axes 212 of all the screws lies. Thus, the lands 106 comprise a web which is disposed substantially vertically compared to the vertically oriented screws as shown in the figures. The lands 106 and the sleeves, in effect, are disposed as continuous, vertically disposed strip 13 along the rear of the screws 16, that is, as a strip 13 which is substantially disposed about a plane which is parallel to a plane containing the axes of all screws.

A preferred feature of the screwstrip 14 is that it may bend to assume a coil-like configuration due to flexibility of the lands 106, such that, for example, the screwstrip could be disposed with the heads of the screws disposed into a helical coil, that is. the plane in which all the axes 212 of the screws lie may assume a coiled, helical configuration to closely pack the screws for use. Having the lands 106 and sleeves as a vertically extending web lying in the plane parallel that in which the axes 212 permits such coiling.

The invention is not limited to use of the collated screwstrips illustrated. Many other forms of screwstrips may be used such as those illustrated in U.S. Pat. No. 3,910,324 to Nasiatka: U.S. Pat. No. 5.083,483 to Takaji; U.S. Pat. No. 4,019,631 to Lejdegard et al and U.S. Pat. No. 4.018,254 to DeCaro.

Figure 14:
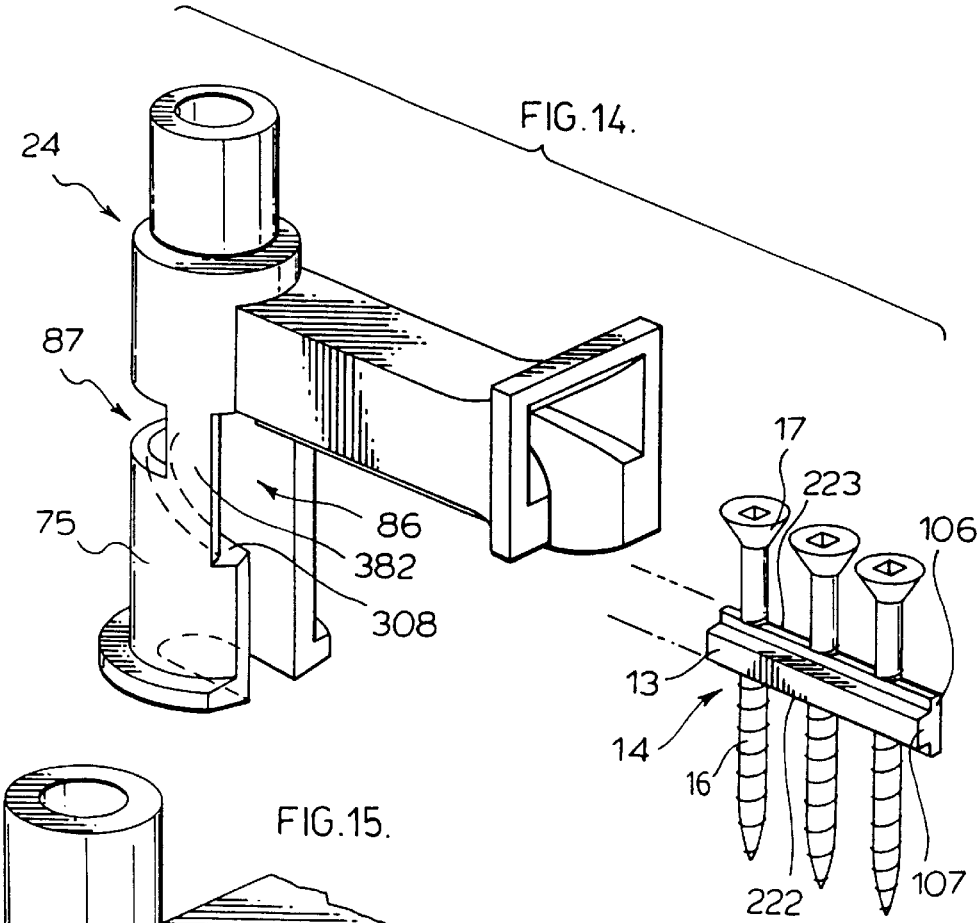
FIG. 14 is a schematic pictorial view of another version of a removable nose portion with a segment of a screwstrip.
Figure 15:
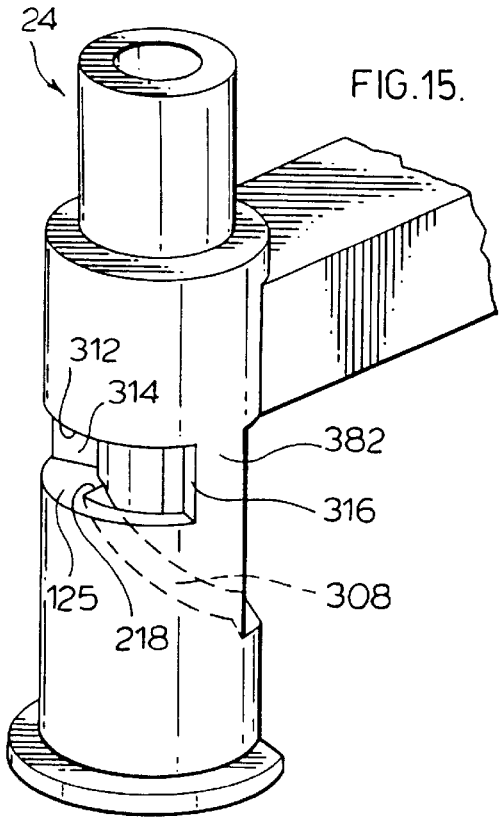
FIG. 15 is a partially cut-away pictorial view of the nose portion of FIG. 14 from a different perspective.

Reference is now made to FIGS. 14 and 15 illustrating a second embodiment of a removable rose portion 24 which is adapted for substitution with the nose portion 24 illustrated in FIGS. 1 to 6. Throughout FIGS. 14 and 15, similar reference numbers are used to refer to similar elements in FIGS. 1 to 11. For simplicity, the nose portion 24 shown in FIGS. 14 and 15 is shown merely in the context of the nose portion and/or with a screwstrip 14 including retaining strip 13 and screws 16. Other elements such as the shuttle 96, the shuttle pawl 99, the lever 48, the drive shaft 34, the bit 122 and the workpiece 124 are not shown for the purposes of simplicity. However, operation and interaction of various parts is substantially the same.

The nose portion 24 of FIGS. 14 and 15 is identical to the nose portion 24 of FIGS. 1 to 6 other than in the configuration of a passageway for the screwstrip radially through the guide tube 75 from the screw access opening 86 to the exit opening 87.

In FIGS. 1 to 6, the guide tube 75 has an outboard side which is completely cut away between the screw access opening 86 and the exit opening 87. In FIGS. 14 and 15, the guide tube 75 is not completely cut away on its outboard side but rather has a continuous portion 382 of its outer wall which separates the screw access opening 86 from the exit opening 87 on the outboard side of the guide tube 75. As used herein, the outboard side is the side to which the strip 13 is deflected when a screw 16 is separated from the screwstrip 14.

To accommodate deflection of the strip 13 away from a screw 16 towards the outboard side, the passageway which extends from the screw access opening or entranceway 86 to the exit opening or exitway 87 is provided on its outboard side with a lateral strip receiving slotway cut to extend to the outboard side from the cylindrical guideway 82.

The access opening 86 forms an entranceway for the screwstrip 14 generally radially into the guideway 82 on one side. The exit opening 87 forms an exitway for portions of the strip 13 from which screws 16 have been driven.

The exit openings or exitway 87 is shown as adapted to encircle the spent strip 13 with the exitway 87 bordered by rearwardly directed forward surface 125, forwardly directed rear surface 312, inboard side surface 314 and outboard side surface 316.

In FIGS. 14 and 15, the screwstrip 14 has been shown in a preferred form for screwstrips which are to comprise discrete length segments. The strip, as seen in FIGS. 14 and 15, has lands 106 of relatively constant cross-section throughout the length of the strip, with an enlarged flange 107 extending along the outboard side of the strip. This structure and particularly the enlarged flange 107 assists in making the strip self-supporting, that is, so that a segment will support the weight of the screws against bending. Flange 107 extends in the axial direction of the screw at least half the height of the lands.

The nose portion 24 is shown as removable for use in an assembly as illustrated. It is to be appreciated that the particular features of the exitway, entranceway and guideway specifically disclosed to assist in driving the last screw in a strip could be used in other guide tubes such as those which are not removable and which may or may not have an associated channelway.

The driver attachment 12 in accordance with this invention and the nose portion 24 described herein are particularly adapted for driving screwstrips 14 in the form of short segments, preferably in the range of about six to eighteen inches in length. One preferred length is about twelve inches so as to hold, for example, about 32 screws of, for example, drywall screws or wood screws. To provide each segment with sufficient rigidity to be self-supporting, it is preferred to provide the strip 13 to have increased dimensions normal the axis of the screw on the outboard side of the screws as, for example, with the lands 106 extending as a continuous web along the outboard side of the screws as seen in FIG. 14. Reinforcing rib or flange 107 may be provided along the entire length of the strip as seen in FIG. 14. Such a reinforcing flange 107 or rib is of assistance in maintaining the axis of the screws in the same plane against coiling. The enlarged slotway in the nose portion of FIG. 14 is readily adapted to accommodate strips of increased width with such lands and ribs as shown.

Preferred strip segments for use with the drive attachment in accordance with this invention are as shown in FIG. 14, segments of discrete length in which the axis of all strips lie in the same flat plane and in which the heads 17 of the screws are all located in a straight line.

Figure 16:
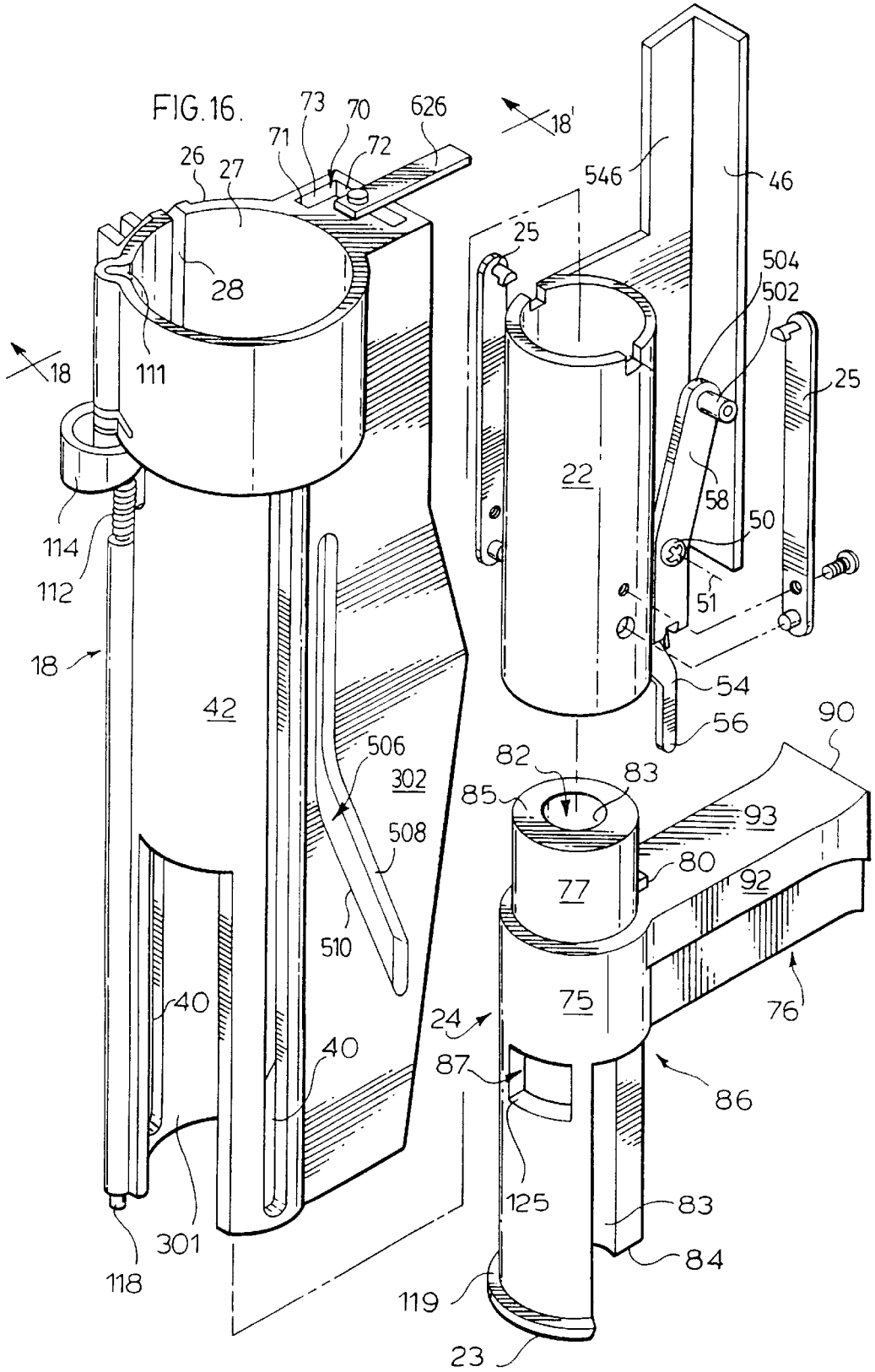
FIG. 16 is an exploded pictorial view of a housing and slide body in accordance with another aspect of the invention, however, substantially the same in most respects to the embodiment shown in FIG. 2.
Figure 17:
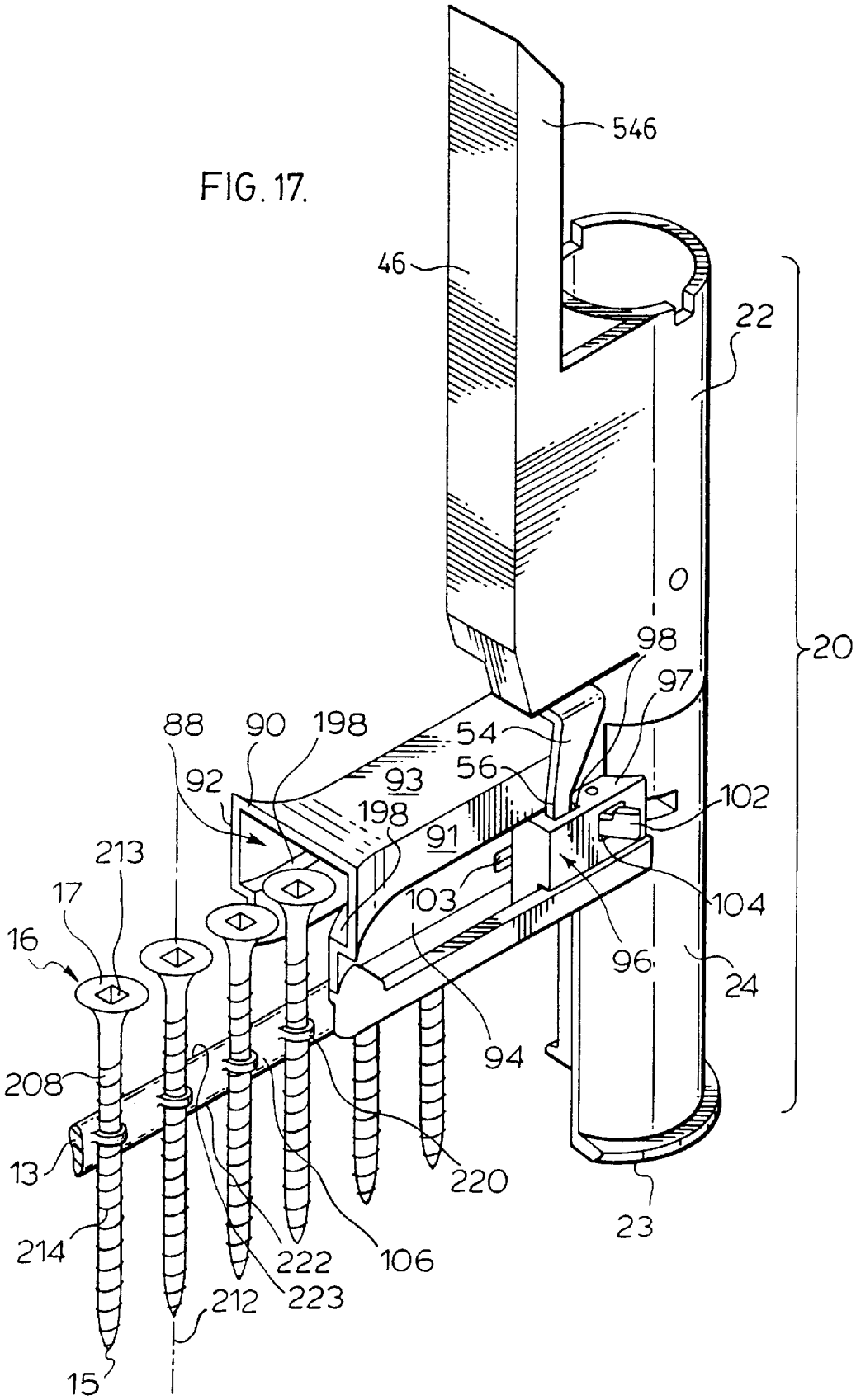
FIG. 17 is a pictorial view of the opposite side of the slide body to that shown in FIG. 16 and with a screwstrip positioned therein in a manner similar to that shown in FIG. 3.

Reference is now made to the embodiment shown in FIGS. 16 to 20. The embodiment of FIG. 16 is substantially the same as the embodiment illustrated in FIGS. 2 to 7, however, with the cam follower 62 of FIG. 2 removed and a separate camming mechanism being provided by a pin 502 being provided on rear arm 58 to be received in a cam slot 506 in the side wall 302 of the housing 18 with camming surfaces 508 and 510 to selectively engage the pin 502 and appropriately move the rear arm 58 with extension and retraction of the slide body in the housing. As shown, the flange element 46 in FIG. 16 has been extended rearwardly as a substantially elongated rearwardly extending side flange element 46. As well. a depending side flange element 546 is provided.

The embodiment of FIG. 16 has also been modified so as to provide what was previously the camming channel 70 in the embodiment of FIG. 2 as a passageway of generally L-shape in horizontal cross-section as seen in FIG. 16. which L-shaped channel 70 is sized so as to permit the side flange element 46 and its depending side flange element 546 to be axially slidable therein.

Figure 18:
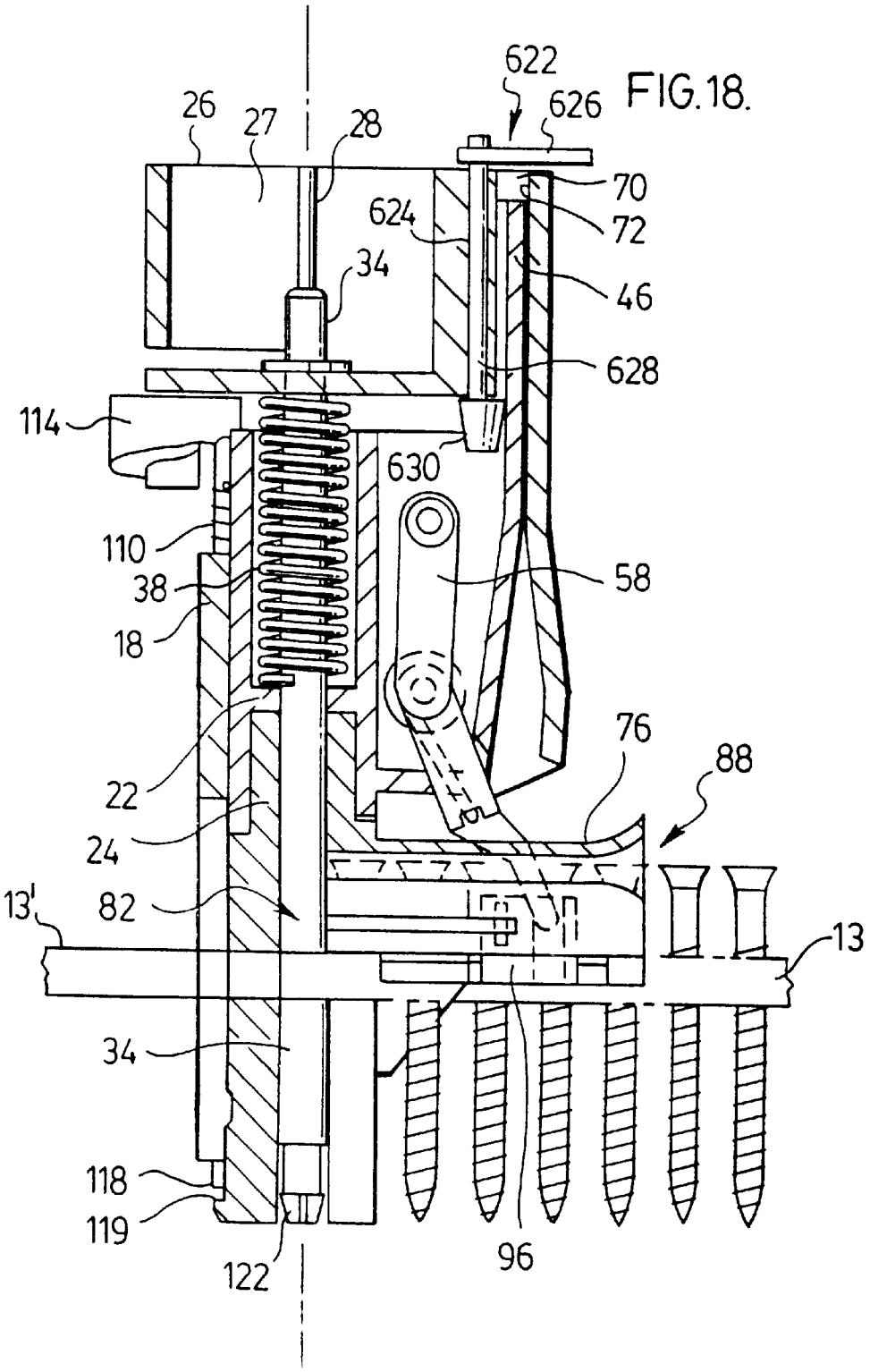
FIG. 18 is a schematic partially cross-sectional view of the driver attachment of FIG. 16 in a fully retracted position similar to that shown in FIG. 7 and in a locked position.

Reference is made to FIG. 18 which shows a schematic cross-sectional view along section line 18—18' in FIG. 16. As shown, the housing 18 has a bore 624 extending therethrough adjacent the L-shaped channel 70 within which there is received a locking mechanism 622. The locking mechanism 622 is schematically shown in an exploded pictorial view in FIG. 19 as comprising a locking lever 626 secured to a shaft rod 628 which carries at its lower end an eccentric cam or wedge member 630. A screw 632 is shown to secure the lever 626 to the rod 628 against relative rotation. Similarly, the wedge member 630 is secured to the rod 628 against relative rotation.

The wedge member 630 is secured to the rod such that relative rotation of the rod 628 within the bore 624 by means of manual movement of the lever 626 will cause side surfaces 632 of the wedge member 630 to move towards or away from the inner side surface 72 of the channel 70. The wedge member 630 is preferably shown as comprising a frustoconical member secured, however, eccentrically from the center axis through the frustoconical member yet mounted for rotation parallel the center axis of the frustoconical member.

Reference is made to FIG. 20 which shows the latching mechanism with the lever 626 rotated into a position such that the wedge member 630 has its side surface 632 spaced away from side wall 72 a distance greater than the thickness of the side flange element 46. With the locking mechanism in the position shown in FIG. 20, the side flange elements 46 and 546 are free to slide axially within the L-shaped channel 70.

FIG. 18 shows the locking lever 626 in a locked position as shown in FIG. 16 in which the wedge member 630 carried by the rod 628 has been rotated into a position in which the wedge-shaped member 630 is placed sufficiently close to the side surface 72 so as to have the side flange element 46 frictionally engaged between the wedge member 630 and the side surface 72. By creating frictional forces holding the side flange element 46 to be greater than those developed by the spring 38, the slide body is locked in the retracted position.

As seen in FIG. 18, the wedge member has side surface 632 which extend away from the side surface 72 as they extend forwardly. This sloped side surface 632 permits the side flange element 46 to be forced rearwardly past the wedge member 360 into the locked position shown in FIG. 18 on retraction of the slide body into the housing.

In use, it is to be appreciated that the locking mechanism may be moved to the latched position as shown in FIG. 18 while the slide body is in an extended position. On subsequent retraction of the slide body into the housing, the side flange element 46 will be forced rearwardly past the wedge member 360 into a frictionally engaged configuration as shown in FIG. 18 against forward extension under the force of the spring 38 until such time as the locking mechanism is moved by movement of the lever 626 to an unlocked position as shown in FIG. 20.

As well, if the slide body may be retracted to the fully retracted position as shown in FIG. 18 with the latching mechanism in the unlocked position, with the slide body in the retracted position as seen in FIG. 20, it is then possible to manually move the lever to the locked position as shown in FIG. 18 so as to lock the side flange element 46 in the channel 70.

In the embodiment shown in FIG. 16, the wedge member 630 is shown as being generally frustoconical. This is not necessary and it may have many other configurations, the dominant characteristic being that, on rotation of the wedge member, portions of the wedge member move closer to and/or away from the walls of the channel 70. The embodiment of FIG. 16 has been discussed with the wedging effect being achieved between the wedge member 630 and the side wall 72. It is also to be appreciated that in substitution thereof or in combination therewith, similar wedging could be provided between the wedge member 630 and the side wall 73 by clamping the side flange element 546 therebetween.

In the embodiment illustrated in FIG. 16, the side flange element 46 and the side flange element 546 are shown as having uniform thickness. It is to be appreciated that either of these could taper. For example, the side flange element 46 could reduce in thickness as it extends rearwardly and upwardly as seen in FIG. 18 to assist in increasing the frictional forces by which it is wedged between the wedge member 630 and the side surface 72 with relative movement rearwardly.

It is to be appreciated that in the embodiment of FIGS. 2 to 7, the latching system utilizes catch members which mechanically engage opposing rearwardly and forwardly directed engagement surfaces. In contrast, in the embodiment as illustrated in FIGS. 16 to 20, the latching system utilizes catch members which frictionally engage opposing side surfaces as in the manner of a friction clutch mechanism.

The friction catch member system of FIGS. 16 to 20 can be adapted to be a mechanical catch member system as follows.

The wedge member 630 has an upper edge 648 between its rear surface 650 and its side surface which is relatively sharply defined as may assist in frictionally engaging the side flange element 46. The side flange element 46 may be provided with one or more vertically spaced, horizontally extending, forwardly directed shoulders for positive engagement by the upper edge 648 of the wedge member 630 and with engagement upon different of the shoulders dependent on the extent to which the slide body is retracted.

As a further modification, the side flange element 46 could carry a catch member which only mechanically catches with the wedge member when the wedge member is in the locked position and save for the catch member, the side flange element 46 is always slidable in the channel 70.

FIG. 19 shows a helical spring 634 to be disposed about rod 628 and located about the rod 628 between the rear upper surface of the wedge member 630 and a lower surface of the housing about the bore 624. The purpose of this spring is to assist, once the lever 626 is placed in any position, in frictionally keeping the lever in that position against movement. Various other mechanisms could be provided to lock the locking lever 626 in any position in which it is to be manually placed. Of course, the locking lever 626 could be replaced by other manually operated mechanisms such as a rotatable thumb screw.

While the invention has been described with reference to preferred embodiment, the invention is not so limited. Many variations and modifications will now occur to persons skilled in the art. For a definition of the invention, reference is made to the appended claims.

I claim:

1. An apparatus for driving with a power driver a screwstrip comprising threaded fasteners which are joined together in a holding strip comprising:

a housing;

an elongated drive shaft for operative connection to a power driver for rotation thereby and defining a longitudinal axis;

a slide body coupled to the housing for displacement parallel to the axis of the drive shaft between an extended position and a retracted position;

a screw feed advance mechanism to engage the screwstrip and successively, incrementally advance fasteners on the screwstrip into axial alignment with said drive shaft for driving of successive fasteners by drive shaft;

an extension limit mechanism activatable to assume an activated configuration and an inactivated configuration, a manual switch for manual operation by a user to switch the extension limit mechanism between the activated configuration and the inactivated configuration, in the activated configuration, the extension limit mechanism does not impede relative sliding of the housing and the slide body between the extended position and the retracted position, in the activated configuration, when the housing and slide body are retracted beyond an extension limit position disposed toward the retracted position from the extended position the extension limit mechanism prevents the housing and slide body from being extended relative each other towards the extended position beyond the extension limit position, in the activated configuration, the extension limit mechanism does not impede the housing and the slide body from being retracted to the extension limit position-towards the retracted position.

2. An apparatus as claimed in claim 1 wherein the elongate drive shaft has a rearmost end for operative connection to a power driver for rotation thereby and a forwardmost end carrying a fastener engaging bit, the slide body carrying guide means about the axis to locate successive of the fasteners in the holding strip advanced by the screw feed advance mechanism axially in alignment with the drive shaft for driving forwardly by the bit out of the holding strip and from the guide means, the slide body also carrying a guide channel extending transversely to the axis to guide the holding strip containing fasteners into the guide means.

3. An apparatus as claimed in claim 2 wherein in the extension limit position the bit is located forward from the holding strip received in the guide means.

4. An apparatus as claimed in claim 2 including a release mechanism activable to permit withdrawal of the screwstrip from the guide channel, the release mechanism activatable whether or not the extension limit mechanism is activated and whether or not the slide body is prevented from being extended relative the housing beyond the extension limit position.

5. An apparatus as claimed in claim 2 wherein when the housing and slide body are in the extension limit position, the bit being accessible radially through the slide body and the housing via complementary radially extending access slots in the same side of the slide body and the housing for removal of the bit from the drive shaft.

6. An apparatus as claimed in claim 2 wherein when the extension limit mechanism is activated, the drive shaft remains rotatable.

7. An apparatus as claimed in claim 2 wherein the guide channel guides the holding strip from which fasteners have been driven out of the guide means and the guide means having an entranceway for entry of the holding strip carrying threaded fasteners from the guide channel and an exitway for exit of the holding strip from which fasteners have been driven.

8. An apparatus as claimed in claim 1 wherein the extension limit position is proximate the retracted position.

9. An apparatus as claimed in claim 1 wherein the extension limit position is the retracted position.

10. An apparatus as claimed in claim 1 including a screwdriving depth adjustment mechanism to adjustably prevent the housing and slide body from being retracted relative each other towards the retracted position beyond a retracted limit position, and wherein when the extension limit mechanism is activated, the screw driving depth adjustment mechanism remains operative for adjustment.

11. An apparatus as claimed in claim 10 wherein the screwdriving depth adjustment mechanism is adjustable to set the retracted limit position at the extended position or spaced from the extended position.

12. An apparatus as claimed in claim 1 wherein the screw feed advance mechanism is coupled between the slide body and the housing whereby displacement of the slide body relative the housing between the extended position and the retracted position activates the screw feed advance mechanism to advance successive fasteners.

13. An apparatus as claimed in claim 1 including a spring biasing the slide body forwardly relative to the housing parallel the axis to the extended position.

14. An apparatus as claimed in claim 1 the extension limit mechanism only switching from the activated configuration to the inactivated configuration by manual operation by a user of the manual switch.

15. An apparatus as claimed in claim 1 wherein in the activated configuration, while the housing and slide body are extended beyond the extension limit position, the extension limit mechanism does not impede relative sliding of the housing and the slide body toward the extended position.

16. An apparatus as claimed in claim 1 wherein in the activated configuration, while the housing and slide body are extended beyond the extension limit position, the extension limit mechanism does not impede relative sliding of the housing and the slide body between the extension limit position and the extended position, in the activated configuration, while the housing and slide body are retracted beyond the extension limit position, the extension limit mechanism does not impede relative sliding of the housing and the slide body between the extension limit position and the retracted position, and in the activated configuration, the extension limit mechanism does not impede relative sliding of the housing and the slide body towards the retracted position through the extension limit position.

17. An apparatus as claimed in claim 1 wherein the extension limit mechanism comprises a friction clutch mechanism.

18. An apparatus for driving with a power driver a screwstrip comprising threaded fasteners which are joined together in a holding strip comprising:

a housing;

an elongate drive shaft for operative connection to a power driver for rotation thereby and defining a longitudinal axis;

a slide body coupled to the housing for displacement parallel to the axis of the drive shaft between an extended position and a retracted position;

a screw feed advance mechanism to engage the screwstrip and successively, incrementally advance fasteners on the screwstrip into axial alignment with said drive shaft for driving of successive fasteners by drive shaft;

an extension limit mechanism activatable to assume an activated configuration and an inactivated configuration, in the activated configuration, the extension limit mechanism does not impede relative sliding of the housing and the slide body between the extended position and the retracted position, in the activated configuration, when the housing and slide body are retracted beyond an extension limit position disposed toward the retracted position from the extended position, the extension limit mechanism prevents the housing and slide body from being extended relative each other towards the extended position beyond the extension limit position, in the activated configuration, the extension limit mechanism does not impede relative sliding of the housing and the slide body from being retracted to the extension limit position towards the retracted position, wherein the elongate drive shaft has a rearmost end for operative connection to a power driver for rotation thereby and a forwardmost end carrying a fastener engaging bit, the extended position is forward of the retracted position;

the slide body carrying guide means about the axis to locate successive of the fasteners in the holding strip advanced by the screw feed advance mechanism axially in alignment with the drive shaft for driving forwardly by the bit out of the holding strip and from the guide means, the slide body also carrying a guide channel extending transversely to the axis to guide the holding strip containing fasteners into the guide means, and wherein the forward end of the drive shaft carries a forwardly opening socket, the bit frictionally received in the socket for removal by axially directed forces, a radially inwardly directed removal slot provided on the drive shaft rearward of the bit and adapted for the radial insertion of a lever tool radially into the removal slot for levered engagement of the bit to urge the bit axially forwardly for removal, wherein when the housing and slide body are in the extension limit position, the bit and the slot being accessible radially through the slide body and the housing via complementary radially extending access slots in the same side of the body and the housing.

19. An apparatus for driving with a power driver a screwstrip comprising threaded fasteners which are joined together in a holding strip comprising:

a housing;

an elongate drive shaft for operative connection to a power driver for rotation thereby and defining a longitudinal axis;

a slide body coupled to the housing for displacement parallel to the axis of the drive shaft between an extended position and a retracted position;

a screw feed advance mechanism to engage the screwstrip and successively, incrementally advance fasteners on the screwstrip into axial alignment with said drive shaft for driving of successive fasteners by drive shaft;

an extension limit mechanism activatable to assume an activated configuration and an inactivated configuration, in the activated configuration, the extension limit mechanism does not impede relative sliding of the housing and the slide body between the extended position and the retracted position, in the activated configuration, when the housing and slide body are retracted beyond an extension limit position disposed toward the retracted position from the extended position, the extension limit mechanism prevents the housing and slide body from being extended relative each other towards the extended position beyond the extension limit position, in the activated configuration, the extension limit mechanism does not impede relative sliding of the housing and the slide body from being retracted to the extension limit position towards the retracted position, wherein the extension limit mechanism comprises a first catch member on the slide body and a second catch member on the housing; one of the first and second catch members being manually adjustable to assume either an activated or an inactivated position, wherein with the adjustable one of the first and second catch members in the activated position, the first and second catch members do not prevent the housing and slide body from being retracted relative each other, however, when the slide body and housing are retracted beyond the extension limit position, the first and second catch members are engagable to prevent the housing and slide body from being extended relative each other beyond the extension limit position, and wherein with the adjustable one of the first and second catch members in the inactivated position, the first and second catch members do not engage to impede relative sliding of the housing and the slide body.

20. An apparatus as claimed in claim 19 including an activation member for manual engagement to locate the adjustable one of the first and second catch members in either its activated or inactivated position.

21. An apparatus as claimed in claim 19 including a spring biasing the slide body forwardly relative to the housing, and wherein the extension limit position is between the extended position and the retracted position and when the extension limit mechanism is activated and the first and second catch members are in engagement preventing the slide body from moving towards the extended position, to release the first and second catch members from engagement requires initial retraction of the slide body against the bias of the spring towards the retracted position from the extension limit position.

22. An apparatus for driving with a power driver a screwstrip comprising threaded fasteners which are joined together in a holding strip comprising:

a housing;

an elongated drive shaft for operative connection to a power driver for rotation thereby and defining a longitudinal axis;

a slide body coupled to the housing for displacement parallel to the axis of the drive shaft between an extended position and a retracted position;

a screw feed advance mechanism to engage the screwstrip and successively, incrementally advance fasteners on the screwstrip into axial alignment with said drive shaft for driving of successive fasteners by drive shaft; and a selectively activatable latching system operatively connected with said housing and said slide body, said latching system, when activated, defining a limit position between said extended position and said retracted position and, when the slide body is displaced relative to the housing between said retracted position and said limit position, said latching system prevents displacement of said slide body toward said extended position beyond said limit position.

* * * * *